US012553231B2

(12) United States Patent
Kitagawa

(10) Patent No.: US 12,553,231 B2
(45) Date of Patent: Feb. 17, 2026

(54) STRUCTURE AND METHOD FOR FABRICATING SAME

(71) Applicant: YUGENKAISHA JAPAN TSUSYO, Kaga (JP)

(72) Inventor: Katsuyuki Kitagawa, Kaga (JP)

(73) Assignee: YUGENKAISHA JAPAN TSUSYO, Kaga (JP)

( * ) Notice: Subject to any disclaimer, the term of this patent is extended or adjusted under 35 U.S.C. 154(b) by 163 days.

(21) Appl. No.: 18/033,956

(22) PCT Filed: Oct. 27, 2021

(86) PCT No.: PCT/JP2021/039676
§ 371 (c)(1),
(2) Date: Apr. 26, 2023

(87) PCT Pub. No.: WO2022/092157
PCT Pub. Date: May 5, 2022

(65) Prior Publication Data

US 2023/0399839 A1 Dec. 14, 2023

(30) Foreign Application Priority Data

Oct. 27, 2020 (JP) ..... 2020-179682

(51) Int. Cl.
*E04B 1/343* (2006.01)
*B63B 35/28* (2006.01)
*B63B 35/44* (2006.01)

(52) U.S. Cl.
CPC ..... *E04B 1/34321* (2013.01); *B63B 35/44* (2013.01); *E04B 1/34384* (2013.01); *B63B 35/28* (2013.01); *E04B 2103/04* (2013.01)

(58) Field of Classification Search
CPC ..... E04B 1/34321; E04B 1/34384; E04B 2103/04; E04B 1/34331; E04B 1/3205;
(Continued)

(56) References Cited

U.S. PATENT DOCUMENTS 2,883,713 A * 4/1959 Zug ..... E04B 1/3445 52/264
6,006,480 A * 12/1999 Rook ..... B32B 13/045 52/762

(Continued)

FOREIGN PATENT DOCUMENTS

JP 4513032 7/2010
JP 3225209 2/2020

(Continued)

OTHER PUBLICATIONS

English Translation of the Search Report and Written Opinion for PCT/JP2021/039676 (7 pages). (Year: 2023).*

(Continued)

*Primary Examiner* — Rodney Mintz
(74) *Attorney, Agent, or Firm* — SNELL & WILMER L.L.P.

(57) ABSTRACT

This structure 100 of the present invention comprises two ceiling members 110*a*, 110*b*, four wall members 120*a*-120*d*, and two floor members 130*a*, 130*b*, wherein each of the four wall members has a first joint edge joined to the two ceiling members, a second joint edge joined to the two floor members, a third joint edge joined to one among the four wall members adjacent to the respective four wall members, and a fourth joint edge joined to another one among the four wall members adjacent to the respective four wall members, and wherein the two ceiling members, the four wall members, and the two floor members are each formed of a foamed body.

15 Claims, 24 Drawing Sheets

(58) Field of Classification Search
CPC ..... E04B 2001/3241; E04B 2001/3252; E04B 2001/327; E04B 2001/3276; E04B 1/0007; E04B 1/348; B63B 35/44; B63B 35/28; B63B 2035/4426; B63B 2231/52; E04H 1/1205; E04H 9/14; E04H 1/02
See application file for complete search history.

(56) References Cited

U.S. PATENT DOCUMENTS

| | | | | |
|---|---|---|---|---|
| 7,882,660 | B2 * | 2/2011 | Kitagawa | E04B 1/3205 52/454 |
| 8,881,470 | B1 * | 11/2014 | Lass | E04H 1/12 52/79.5 |
| 2005/0166475 | A1 | 8/2005 | Kitagawa | |
| 2009/0126292 | A1 | 5/2009 | Kitagawa | |
| 2018/0347176 | A1 * | 12/2018 | Cho | E04B 1/98 |

FOREIGN PATENT DOCUMENTS

| | | |
|---|---|---|
| KR | 20050019816 | 3/2005 |
| KR | 20070118246 | 12/2007 |

OTHER PUBLICATIONS

English Translation of the International Preliminary Report on Patentability Chapter I for PCT/JP2021/039676 (5 pages). (Year: 2023).*
JPO; Office Action issued Feb. 3, 2021 in JP Application No. 2020-179682.
ISA; International Search Report and Written Opinion dated May 5, 2022 in PCT/JP2021/039676.
ISA; International Search Report and Written Opinion dated Dec. 21, 2021 in PCT/JP2021/039676.
Korean Intellectual Property Office, Notice of Preliminary Rejection dated Jun. 16, 2025, in Application No. 10-2023-7015785.

* cited by examiner

Second flood member
(back floor member 130b)

First floor member
(front floor member 130a)

Third ceiling member
(front ceiling member for expansion 210c)

Third floor member
(front floor member for expansion 210c)

(a) (b) (c)

STRUCTURE AND METHOD FOR FABRICATING SAME

CROSS-REFERENCE TO RELATED APPLICATIONS

This application is a national stage application of PCT/JP2021/039676, filed on Oct. 27, 2021, which claims priority to JP Application No. 2020-179682, filed on Oct. 27, 2020. both of which are hereby incorporated by reference in their entirety for all purposes.

TECHNICAL FIELD

The present invention relates to a structure providing an internal space and a method of fabricating such a structure by joining a plurality of members.

BACKGROUND ART

Conventional structures that provide a living space include structures that can be assembled by combining parts made of extruded polystyrene foam or fiber reinforced plastic (FRP). For example, Patent Literature 1 discloses a prefabricated dome erected on a concrete foundation slab as such a structure.

CITATION LIST

Patent Literature

[PTL 1] International Publication No. WO 2004/005633

SUMMARY OF INVENTION

Technical Problem

The objective of the present invention is to obtain a structure, which can float on water, as a structure that provides an internal space and to obtain a fabrication method of such a structure.

Solution to Problem

The present invention provides, for example, the following items.

(Item 1)

A structure comprising:

at least one ceiling member;

at least four wall members; and at least one floor member;

wherein each of the at least four wall members has:

a first joint edge that is joined to the at least one ceiling member;

a second joint edge that is joined to the at least one floor member;

a third joint edge that is joined to one of the at least four wall members adjacent to each of the at least four wall members; and a fourth joint edge that is joined to the other one of the at least four wall members adjacent to each of the at least four wall members;

wherein each of the at least one ceiling member, the at least four wall members, and the at least one floor member is made of foam.

(Item 2)

The structure of item 1, wherein the at least one ceiling member comprises a first ceiling member and a second ceiling member, and each of the first ceiling member and the second ceiling member comprises a first joint edge, a second joint edge, a third joint edge, and a fourth joint edge, the at least four wall members comprise a first wall member, a second wall member, a third wall member, and a fourth wall member, the at least one floor member comprises a first floor member and a second floor member, and each of the first floor member and the second floor member comprises a first joint edge, a second joint edge, a third joint edge, and a fourth joint edge, the first joint edge of the first wall member is joined to the first joint edge of the first ceiling member, the second joint edge of the first wall member is joined to the first joint edge of the first floor member, the third joint edge of the first wall member is joined to the fourth joint edge of the third wall member, and the fourth joint edge of the first wall member is joined to the third joint edge of the fourth wall member, the first joint edge of the second wall member is joined to the second joint edge of the second ceiling member, the second joint edge of the second wall member is joined to the second joint edge of the second floor member, the third joint edge of the second wall member is joined to the fourth joint edge of the fourth wall member, and the fourth joint edge of the second wall member is joined to the third joint edge of the third wall member, the first joint edge of the third wall member is joined to the third joint edge of the first ceiling member and the third joint edge of the second ceiling member, and the second joint edge of the third wall member is joined to the third joint edge of the first floor member and the third joint edge of the second floor member, the first joint edge of the fourth wall member is joined to the fourth joint edge of the first ceiling member and the fourth joint edge of the second ceiling member, and the second joint edge of the fourth wall member is joined to the fourth joint edge of the first floor member and the fourth joint edge of the second floor member, the second joint edge of the first ceiling member is joined to the first joint edge of the second ceiling member, and the second joint edge of the first floor member is joined to the first joint edge of the second floor member.

(Item 3)

An expandable structure comprising:

a plurality of ceiling members;

at least one ceiling member for expansion;

a plurality of wall members;

a plurality of floor members; and at least one floor member for expansion;

wherein the at least one ceiling member for expansion is joined between two of the plurality of ceiling members to form an expanded ceiling section, wherein the at least one floor member for expansion is joined between two of the plurality of floor members to form an expanded floor section, wherein the expanded ceiling section is joined to the expanded floor section with the plurality of wall members, and wherein each member is made of foam.

(Item 4)

The structure of item 3, wherein each of the plurality of floor members has four joint edges, and three of the four joint edges of each of the plurality of floor members have a shape that is joined to the plurality of wall members, and each of the at least one floor member for expansion has four joint edges, and two of the four joint edges of each of the at least one floor member for expansion have a shape that is joined to the plurality of wall members.

(Item 5)

The structure of item 3 or 4, wherein each of the plurality of ceiling members has four joint edges, and three of the four joint edges of each of the plurality of ceiling members have a shape that is joined to the plurality of wall members, and each of the at least one ceiling member for expansion has four joint edges, and two of the four joint edges of each of the at least one ceiling member for expansion have a shape that is joined to the plurality of wall members.

(Item 6)

The structure of any one of items 1 to 5, wherein a ratio of a base area ($m^2$) of the structure to a weight of the structure itself (kg) is 1:30 to 1:80.

(Item 7)

The structure of any one of items 1 to 6, further comprising a coating, wherein the coating is configured to at least cover each joint section of the plurality of members constituting the structure.

(Item 8)

The structure of item 7, wherein the coating is formed to cover the entire outer surface of the structure.

(Item 9)

The structure of any one of items 1 to 6, wherein each of the plurality of members constituting the structure comprises a coating that covers itself.

(Item 10)

The structure of any one of items 7 to 9, wherein a material of the coating at least has a waterproof property.

(Item 11)

The structure of any one of items 1 to 10, wherein the floor member has a first portion constituting a floor of the structure and a second portion constituting a part of a wall of the structure, and the first portion and the second portion are integrally formed.

(Item 12)

The structure of item 11, wherein the wall has a first opening, and the first opening is surrounded by the ceiling member, the wall members, and the floor member.

(Item 13)

The structure of item 11 or 12, wherein the wall has a second opening, and the second opening is surrounded by the ceiling member and the wall members.

(Item 14)

The structure of any one of items 1 to 13, wherein the structure further comprises an external floor member constituting an external deck on the outside of the floor member of the structure, and the external floor member is joined to the floor member.

(Item 15)

The structure of any one of items 1 to 14, wherein the ceiling member is made of first foam having a first expansion ratio, the wall members are made of second foam having a second expansion ratio, the floor member is made of third foam having a third expansion ratio, and the third expansion ratio is less than the first expansion ratio and the second expansion ratio.

(Item 16)

The structure of any one of items 1 to 15, wherein the foam comprises polystyrene foam.

(Item 17)

A method of fabricating a structure, comprising: providing at least one ceiling member, at least four wall members, and at least one floor member, wherein each member is made of foam;

joining the at least four wall members to the at least one ceiling member and the at least one floor member, wherein each of the at least four wall members has at least four joint edges, and the at least four joint edges comprise a first joint edge that is joined to the at least one ceiling member, a second joint edge that is joined to the at least one floor member, a third joint edge that is joined to one of the at least four wall members adjacent to each of the at least four wall members, and a fourth joint edge that is joined to the other one of the at least four wall members adjacent to each of the at least four wall members; and applying a coating to at least cover joint sections of each joined member.

(Item 18)

A method of fabricating a structure, comprising:

providing a plurality of ceiling members, at least one ceiling member for expansion, a plurality of wall members, a plurality of floor members, and at least one floor member for expansion, wherein each member is made of foam;

joining the at least one ceiling member for expansion between two of the plurality of ceiling members to form an expanded ceiling section;

joining the at least one floor member for expansion between two of the plurality of floor members to form an expanded floor section;

joining the plurality of wall members to the expanded ceiling section and floor section; and applying a coating to at least cover joint sections of each joined member.

Advantageous Effects of Invention

The present invention can obtain a structure, which can float on water, as a structure that provides an internal space and obtain a fabrication method of such a structure.

DESCRIPTION OF EMBODIMENTS

As used herein, "about" refers to a range of ±10% from the number that is described subsequent to "about".

[First Structure of the Invention]

The technical problem of the first structure of the invention is to obtain a structure that can float on water, which provides an internal space. The aforementioned technical problem is solved by providing a structure comprising:

at least one ceiling member;

at least four wall members; and at least one floor member;

wherein each of the at least four wall members has:

a first joint edge that is joined to the at least one ceiling member;

a second joint edge that is joined to the at least one floor member;

a third joint edge that is joined to one of the at least four wall members adjacent to each of the at least four wall members; and a fourth joint edge that is joined to the other one of the at least four wall members adjacent to each of the at least four wall members;

wherein each of the at least one ceiling member, the at least four wall members, and the at least one floor member is made of foam.

Such a first structure of the invention, which has at least one ceiling member, at least four wall members, and at least one floor member, wherein each member is made of foam and has joint edges joined to an adjacent member, is not particularly limited in terms of other configurations.

Furthermore, the structure is expandable. The dimensions of the structure can be readily expanded in the direction of length of two opposing wall members among the four wall members in this structure.

Specifically, the dimensions of side walls of the structure can be expanded by replacing two opposing wall members among four wall members with wall members having a greater length, or by adding on wall members with the same shape to each of the opposing two wall members. When expanding the dimensions of the side walls of the structure, the dimensions of the ceiling and floor of the structure can be expanded by replacing each of the ceiling member and floor member with a member having a greater dimension or by adding on a ceiling member and floor member with the same shape as the ceiling member and the floor member in the same manner as the replacement and addition of wall members.

Figure 1:
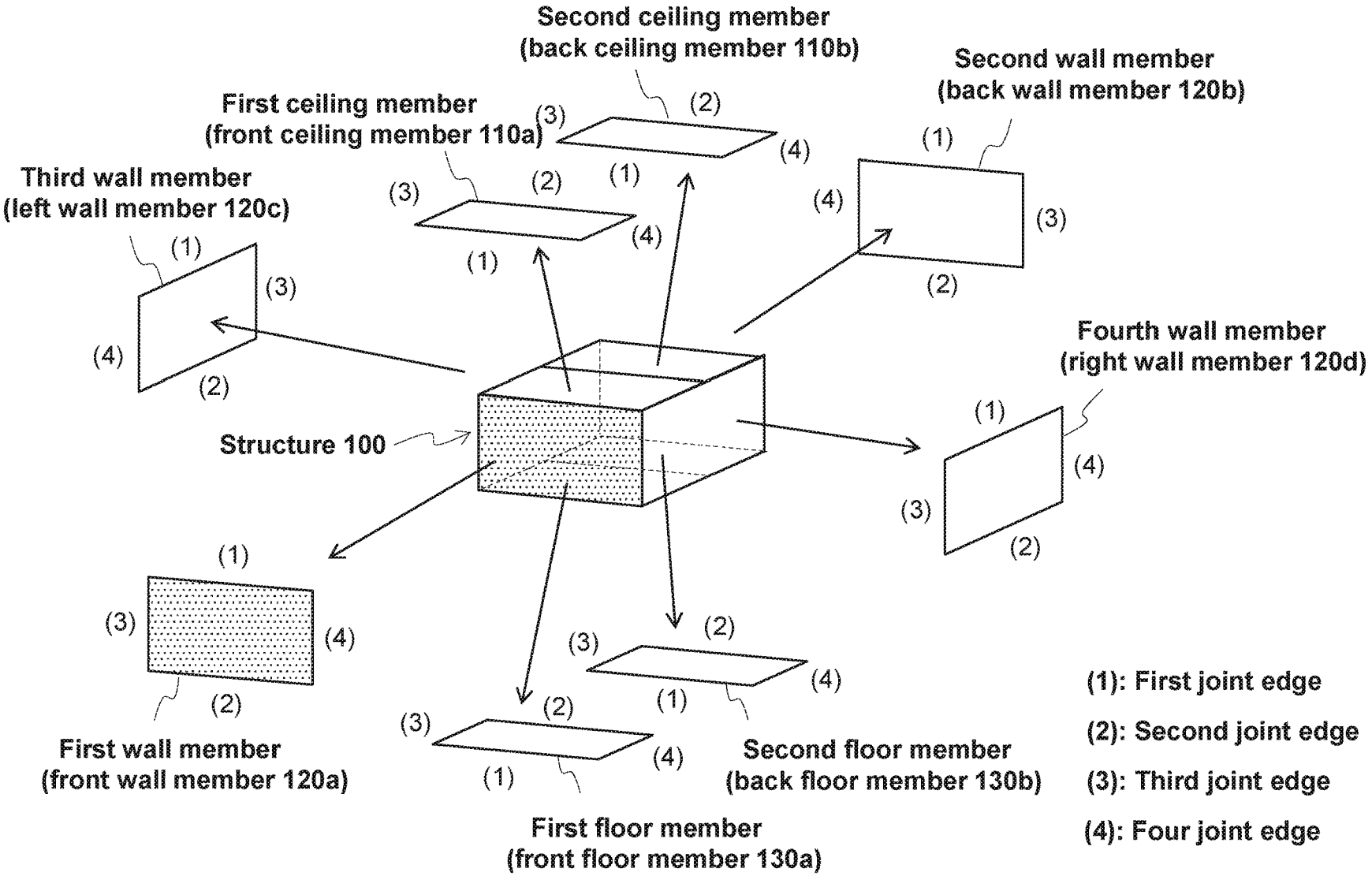
FIG. 1 is a diagram schematically showing the structure of the invention, which shows the arrangement of two ceiling members, four wall members, and two floor members in the structure, and the positional relationship of first to fourth joint edges in each member.

FIG. 1 is a diagram schematically showing the first structure of the invention, which shows the arrangement of two ceiling members, four wall members, and two floor members in the structure, and the positional relationship of first to fourth joint edges in each member.

In this regard, the dotted wall member is a first wall member (front wall member) 120*a*, and wall members positioned on the back side, left side, and right side of the first wall member in the diagram of FIG. 1 are second to fourth wall members 120*b* to 120*d* in order. For ceiling members, two ceiling members positioned in the front and back in the diagram are first ceiling member (front ceiling member) 110*a* and second ceiling member (back ceiling member) 110*b*, respectively. For floor members, two floor members positioned in the front and back in the diagram are first floor member (front floor member) 130*a* and second floor member (back floor member) 130*b*, respectively.

Four joint edges of each wall member are first to fourth joint edges (1) to (4) in the order of top, bottom, left, and right toward each wall member. The four joint edges of each ceiling member are first to fourth joint edges (1) to (4) in the order of the proximal side, distal side, left side, and right side in the diagram of FIG. 1 in each ceiling member. The four joint edges of each floor member are first to fourth joint edges (1) to (4) in the order of the proximal side, distal side, left side, and right side in the diagram of FIG. 1 in each floor member.

In one exemplary embodiment, at least one ceiling member can comprise a first ceiling member 110*a* and a second ceiling member 110*b*, at least four wall members can comprise a first wall member 120*a* to a fourth wall member 120*d*, and at least one floor member can comprise a first floor member 130*a* and a second floor member 130*b*.

In another embodiment, each of the first ceiling member 110*a* and the second ceiling member 110*b* can comprises a first joint edge (1) to a fourth joint edge (4), each of the first wall member 120*a* to the fourth wall member 120*d* can comprise a first joint edge (1) to a fourth joint edge (4), and each of the first floor member 130*a* and the second floor member 130*b* can comprise a first joint edge (1) to a fourth joint edge (4).

In this regard, the first joint edge (1) of the first wall member 120*a* can be joined to the first joint edge (1) of the first ceiling member 110*a*, the second joint edge (2) of the first wall member 120*a* can be joined to the first joint edge (1) of the first floor member 130*a*, the third joint edge (3) of the first wall member 120*a* can be joined to the fourth joint edge (4) of the third wall member 120*c*, and the fourth joint edge (4) of the first wall member 120*a* can be joined to the third joint edge (3) of the fourth wall member 120*d*.

Further, the first joint edge (1) of the second wall member 120*b* can be joined to the second joint edge (2) of the second ceiling member 110*b*, the second joint edge (2) of the second wall member 120*b* can be joined to the second joint edge (2) of the second floor member 130*b*, the third joint edge (3) of the second wall member 120*b* can be joined to the fourth joint edge (4) of the fourth wall member 120*d*, and the fourth joint edge (4) of the second wall member 120*b* can be joined to the third joint edge (3) of the third wall member 120*c*.

Furthermore, the first joint edge (1) of the third wall member 120*c* can be joined to the third joint edge (3) of the first ceiling member 110*a* and the third joint edge (3) of the second ceiling member 110*b*, and the second joint edge (2) of the third wall member 120*c* can be joined to the third joint edge (3) of the first floor member 130*a* and the third joint edge (3) of the second floor member 130*b*.

The first joint edge (1) of the fourth wall member 120*d* can be joined to the fourth joint edge (4) of the first ceiling member 110*a* and the fourth joint edge (4) of the second ceiling member 110*b*, and the second joint edge (2) of the fourth wall member 120*d* can be joined to the fourth joint edge (4) of the first floor member 110*a* and the fourth joint edge (4) of the second floor member 130*b*.

Furthermore, the second joint edge (2) of the first ceiling member 110*a* can be joined to the first joint edge (1) of the second ceiling member 110*b*, and the second joint edge (2) of the first floor member 130*a* can be joined to the first joint edge (1) of the second floor member 130*b*.

In this manner, not only the ceiling and walls, but also the floor and the bottom surface of the structure is composed of foam in the first structure of the invention. The first structure of the invention does not require a frame or framework other than the ceiling member, wall members, and floor member. Thus, every part other than a window and a door can be composed of foam. In view of the above, the first structure of the invention is light weight and capable of floating on water.

For example, a structure that can float on water can float on water while supporting a given weight in addition to the structure's own weight. For example, a structure can float on water while supporting about 100 kg to about 500 kg of weight per unit area (1 $m^2$) of the bottom surface. The ratio of the base area of the structure to the weight that can be supported in addition to its own weight (base area ($m^2$): weight (kg)) is, for example, 1:60 to 1:800, preferably 1:100 to 1:500, and more preferably 1:100 to 1:200.

For example, if the structure of the invention can support a weight of about 100 kg per unit area (1 $m^2$) in addition to its own weight (i.e., base area ($m^2$):weight (kg)=1:100), the structure would be able to support the weight of one adult or approximately furniture that can be held by a person (about 100 kg or less) per 1 $m^2$. For example, if the structure of the invention can support a weight of about 100 kg to about 200 kg per unit area (1 $m^2$) in addition to its own weight (i.e., base area ($m^2$):weight (kg)=1:100 to 1:200), two adults (about 100 kg to about 200 kg), or weight of heavy furniture combined with its content (about 100 kg to about 200 kg) can be comfortably accommodated on a 1 $m^2$ floor surface. This allows the structure to be used as a living space on water.

A structure generates a buoyant force equal to the immersed amount. For example, a structure can generate a buoyant force of about 150 kg per unit area (1 $m^2$) by sinking in by the thickness of the bottom (about 150 mm), and achieve a supported weight of about 150 kg per unit area (i.e., base area ($m^2$):total weight (kg)=1:150).

For example, if a bottom surface area of a structure is assumed to be about 16 $m^2$ (about 4 m×about 4 m), a buoyant force of about 2400 kg is generated by immersion of about 150 mm.

The inventor's empirical estimate of the weight of a simple house composed of foam (base area of about 10 $m^2$) is about 600 kg. In view of the above, the weight of a structure with a base area of about 16 $m^2$ would be about 1000 kg (≈(about 600/about 10)×about 16), so that the weight that can be supported by the structure in addition to its own weight is about 2400 kg-about 1000 kg, which is approximately 1400 kg. Thus, the weight per unit area (1 $m^2$) that can be supported by the structure in addition to its own weight is about 100 kg (≈1400/16) (i.e., base area ($m^2$):weight (kg)=1:80 to 1:100).

If a floor member of a structure has wainscoting provided along the circumference of the floor member, the structure can sink to the height of the wainscoting because water would not infiltrate into the structure due to the presence of the wainscoting up to the height of the wainscoting. In other words, a structure can have a maximum supported weight corresponding to the height of wainscoting. If, for example, the height of wainscoting is about 500 mm, a weight of about 500 kg per unit area (1 $m^2$) can be supported (i.e., base area ($m^2$):total weight (kg)=1:500).

This means that a buoyant force of about 8000 kg (about 500 kg×about 16 $m^2$) is generated for a structure with a base area of about 16 $m^2$ (about 4 m×about 4 m). Assuming that the structure's own weight is about 1000 kg, the structure can support a weight of about 7000 kg after subtracting its own weight, which is about 400 kg per unit area (1 $m^2$) (about 7000 kg/about 16 $m^2$) (i.e., base area ($m^2$):weight (kg)=1:400 to 1:500).

The height of wainscoting itself can be a height at which the dimension of the thickness of a floor member plus the height of the wainscoting is about 500 mm or greater (about 350 mm or greater). For example, if the thickness of a floor member is about 150 mm, the height of wainscoting can be about 350 mm or greater such as about 650 mm.

A structure has a weight that can achieve the property of being floatable on water. For example, a structure has a weight at which it can float on water while supporting a weight of about 100 kg to about 500 kg per unit area (1 $m^2$) of the bottom surface in addition to its own weight. The ratio of the base area of the structure to the structure's own weight (base area ($m^2$):own weight (kg)) is, for example, 1:30 to 1:80, preferably 1:40 to 1:70, and more preferably 1:50 to 1:65 in view of the simple house described above (about 10 $m^2$/a bout 600 kg).

For example, a buoyant force of about 150 kg per unit area (1 $m^2$) can be generated by sinking in by the thickness of the bottom (about 150 mm) as described above. Thus, if for example base area ($m^2$):own weight (kg)=1:30, a structure can support a weight of about 120 kg in addition to its own weight. If base area ($m^2$):own weight (kg)=1:80, the structure can support a weight of about 70 kg in addition to its own weight.

Further, infiltration of water and moisture from the surface supporting the structure (e.g., ground, water surface, or the like) can be prevented by the waterproof and moisture-proof property of foam. This makes it difficult for water to infiltrate if, for example, the first structure of the invention is installed on water. If, for example, the first structure of the invention is installed on land, the bottom does not need to be raised with a foundation or block made of concrete or the like. Specifically, the first structure of the invention can be installed without a foundation or raised bottom, so that the structure has a technical advantage of being installable at locations in various states. The first structure of the invention can be installed even on, for example, grassland, sand, frozen ground, or the like.

The first structure of the invention is configured so that the floor member is separated into the front floor member 130*a* and the back floor member 130*b*, and the ceiling member is separated into the front ceiling member 110*a* and the back ceiling member 110*b*, while each of the left wall member 120*c* and the right wall member 120*d* sandwiched between the floor member and the ceiling member spans across the front floor member 130*a* and the back floor member 130 and the front ceiling member 110*a* and the back ceiling member 110*b*. Thus, the first structure has a structure in which the floor member and the ceiling member separated into two members are reinforced by the left wall member 120*c* and the right wall member 120*d*.

[Second Structure of the Invention]

The technical problem of the second structure of the invention is to obtain a structure that can float on water, which provides an internal space. The aforementioned technical problem is solved by providing an expandable structure comprising:

a plurality of ceiling members;

at least one ceiling member for expansion;

a plurality of wall members;

a plurality of floor members; and at least one floor member for expansion;

wherein the at least one ceiling member for expansion is joined between two of the plurality of ceiling members to form an expanded ceiling section, wherein the at least one floor member for expansion is joined between two of the plurality of floor members to form an expanded floor section, wherein the expanded ceiling section is joined to the expanded floor section with the plurality of wall members, and wherein each member is made of foam.

Thus, the second structure of the invention, which is expandable and has a plurality of ceiling members, a plurality of wall members, and a plurality of floor members, as well as at least one ceiling member for expansion and at least one floor member for expansion, wherein each member is made of foam, wherein an expanded ceiling section is formed by the at least one ceiling member for expansion being joined between two ceiling members, wherein an expanded floor section is formed by the at least one floor member for expansion being joined between two floor members, and wherein the expanded ceiling section and the expanded floor section are joined to the plurality of wall members, is not particularly limited in terms of other configurations.

In one exemplary embodiment of the second structure, each of the plurality of floor members can have four joint edges, and three of the four joint edges of each of the floor members can have a shape that is joined to the plurality of wall members, and each of the at least one floor member for expansion can have four joint edges, and two of the four joint edges of each of the floor members for expansion can have a shape that is joined to the plurality of wall members.

In one embodiment of the second structure, each of the plurality of ceiling members can have four joint edges, and three of the four joint edges of each of the ceiling members can have a shape that is joined to the plurality of wall members, and each of the at least one ceiling member for expansion can have four joint edges, and two of the four joint edges of each of the ceiling members for expansion can have a shape that is joined to the plurality of wall members.

Furthermore, the first structure or the second structure can have a coating covering each joint section of the plurality of members constituting the structure. This can improve the strength of the joint sections. Furthermore, the coating can be formed to cover the entire outer surface of the structure. This can improve the overall structural strength of the structure.

Preferably, the material of the aforementioned coating at least has a waterproof property. Rain water or the like can be prevented from infiltrating from a joint section of each member by the waterproof property of the material of the coating. When floating on water, infiltration of water from a joint section of each member can be prevented.

Alternatively, each of the plurality of members constituting the first structure or the second structure can comprise a coating that covers itself. This can improve the strength of each of the plurality of members, and therefore the overall structural strength of the structure. In such a case, a joint section of each member can be coated with a caulking material. This can improve the strength of the joint section. A waterproof caulking material can prevent infiltration of rain water or the like from the joint section of each member. When floating on water, infiltration of water from a joint section of each member can be prevented.

In the first structure or the second structure, the floor member preferably has a first portion (floor board section) constituting a floor of the structure and a second portion (wainscoting) constituting a part of a wall of the structure, and the first portion and the second portion are integrally formed. In such a case, there is no joint section (joint) between the floor and the wall of the structure, so that water infiltration from below through a joint (e.g., infiltration of water from the below when floated on water, or infiltration of moisture from below when installed on land) can be avoided.

In another embodiment, the wall of the first structure or the second structure can have a first opening, and the first opening can be surrounded by the ceiling member, the wall members, and the floor member. Furthermore, the wall can have a second opening, and the second opening can be surrounded by the ceiling member and the wall members.

However, the first opening and the second opening can be included inside a wall member instead of being surround by the ceiling member and the wall members.

The first structure or the second structure preferably further comprises an external floor member constituting an external deck disposed outside of the floor member of the structure, and the external floor member is joined to the floor member. In such a case, the floor of the first structure or the second structure can be expanded as a deck portion with the external floor member. The deck portion can not only increase the floor area, but also increase the buoyant force of the structure.

In the first structure or the second structure, the ceiling member, the wall members, and the floor member are each made of foam, and the expansion ratio of foam constituting the floor member is preferably less than the expansion ratio of foam constituting the ceiling member and the expansion ratio of foam constituting the wall members. An expansion ratio of foam of a floor member less than the expansion ratios of foam of a ceiling member and wall members can increase the density of the floor member to be higher than the densities of the ceiling member and the wall members and lower the center of gravity of the structure, so that the stability of the structure when installed on land or when floated on water can be improved.

In this regard, the foam constituting the ceiling member, wall members, and floor member can comprise foam resin such as polystyrene foam. For the foam, the material of resin is not limited and can be anything, as long as the resin raw material is foamed. Examples of foam resin other than polystyrene foam include polypropylene foam, polyurethane foam, polyolefin foam, and the like.

Furthermore, the aforementioned coating material has a waterproof property, but the coating material can be nonflammable because a certain degree of nonflammable property is required by law (Building Standard Law in Japan) for the exterior of structures utilized as a residence depending on the country.

It is envisioned that a structure may not be in compliance with the building code with only a nonflammable coating depending on the country. In such a case, treatment for imparting a nonflammable property to the exterior of the structure is required after assembling the structure on site.

Treatment for imparting a nonflammable property include, for example, treatment for blowing on resin mortar on the surface of an assembled structure. Treatment for applying a nonflammable panel or a steel plate (e.g., Galvalume® steel plate) to the surface of an assembled structure and the like is also conceivable.

Since the first structure 100 or second structure 200 has a box configuration by combining a floor member, wall members, and ceiling member, the structure has a bottom. Thus, the structure can be installed simply by placing the structure on any roughly horizontal location just like a freight container, even without a foundation. The installation site of the first structure 100 or second structure 200 can be in any state, as long as the site is roughly horizontal. The first structure 100 or the second structure 200 can be installed even on, for example, grassland, sand, frozen ground, or the like.

While some countries require a concrete foundation by law as in Japan (Building Standard Law) for structures used as residence, some countries legally allow structures used as residence that are simply placed or secured to the ground with a retaining apparatus such as a metal clamp as residence. The advantageous of the structure, i.e., the structure can be installed by simply placing the structure in view of having a bottom, would be a major strength in such countries.

[Method of Assembling the First Structure of the Invention]

The method of assembling the first structure of the invention only needs to comprise at least the following two steps, i.e., the first step and the second step.

The first step is a step of providing at least one ceiling member, at least four wall members, and at least one floor member. In this regard, each member is made of foam.

The second step is a step of joining the at least four wall members to the at least one ceiling member and the at least one floor member. In this regard, each of the at least four wall members has at least four joint edges, and the at least four joint edges comprise a first joint edge that is joined to the at least one ceiling member, a second joint edge that is joined to the at least one floor member, a third joint edge that is joined to one of the at least four wall members adjacent to each of the at least four wall members, and a fourth joint edge that is joined to the other one of the at least four wall members adjacent to each of the at least four wall members.

The method of assembling the first structure of the invention can comprise, for example, the following third step.

The third step is a step of applying a coating to at least cover joint sections of each joined member.

In view of the above, the first structure of the invention can comprise a coating covering joint sections of each joined member. Any material can be selected as the coating material in accordance with the objective. Preferably, a material with a waterproof property or high strength is selected. For example, the strength of a joint section can be improved by coating. A waterproof property of the coating material can prevent infiltration of rain water or the like from a joint section of each member. Infiltration of water from a joint section of each member can also be prevented when floating on water.

Specific examples of coating material include, but are not limited to, waterproof urethane resin. Examples of coating material include polyuria resin with a waterproof property and high strength.

[Method of Assembling the Second Structure of the Invention]

A method of assembling the second structure of the invention only needs to comprise at least the following four steps, i.e., first to fourth steps.

The first step is a step of providing a plurality of ceiling members, at least one ceiling member for expansion, a plurality of wall members, a plurality of floor members, and at least one floor member for expansion. In this regard, each member is made of foam.

The second step is a step of joining the at least one ceiling member for expansion between two of the plurality of ceiling members to form an expanded ceiling section.

The third step is a step of joining the at least one floor member for expansion between two of the plurality of floor members to form an expanded floor section.

The fourth step is a step of joining the plurality of wall members to the expanded ceiling section and floor section.

The method of assembling the second structure of the invention can comprise, for example, the following fifth step.

The fifth step is a step of applying a coating to at least cover joint sections of each joined member.

In view of the above, the second structure of the invention can comprise a coating covering joint sections of each joined member, whereby the strength and waterproof property of the joint sections is improved. The aforementioned coating material preferably has at least a waterproof property. A waterproof property of the coating material can prevent infiltration of rain water or the like from a joint section of each member. Infiltration of water from a joint section of each member can also be prevented when floating on water.

In this manner, the first structure of the invention, which has at least one ceiling member, at least four wall members, and at least one floor member, wherein each member is made of foam and has joint edges joined to an adjacent member, is not particularly limited in terms of other configurations. The following Embodiment 1 describes a first structure having two ceiling members, four wall members, and two floor members.

The second structure of the invention, which is expandable and has a plurality of ceiling members, a plurality of wall members, and a plurality of floor members, as well as at least one ceiling member for expansion and at least one floor member for expansion, wherein each member is made of foam, wherein an expanded ceiling section is formed by joining the at least one ceiling member for expansion between two ceiling members, wherein an expandable floor section is formed by joining the at least one floor member for expansion between two floor members, and wherein the expanded ceiling section and the expanded floor section are joined to the plurality of wall members, is not particularly limited in terms of other configurations. The following Embodiment 2 describes a second structure having two ceiling members, six wall members, and two floor members, as well as two ceiling members for expansions and two floor members for expansion.

The embodiments of the invention are described hereinafter while referring to the drawings.

Embodiment 1

Figure 2:
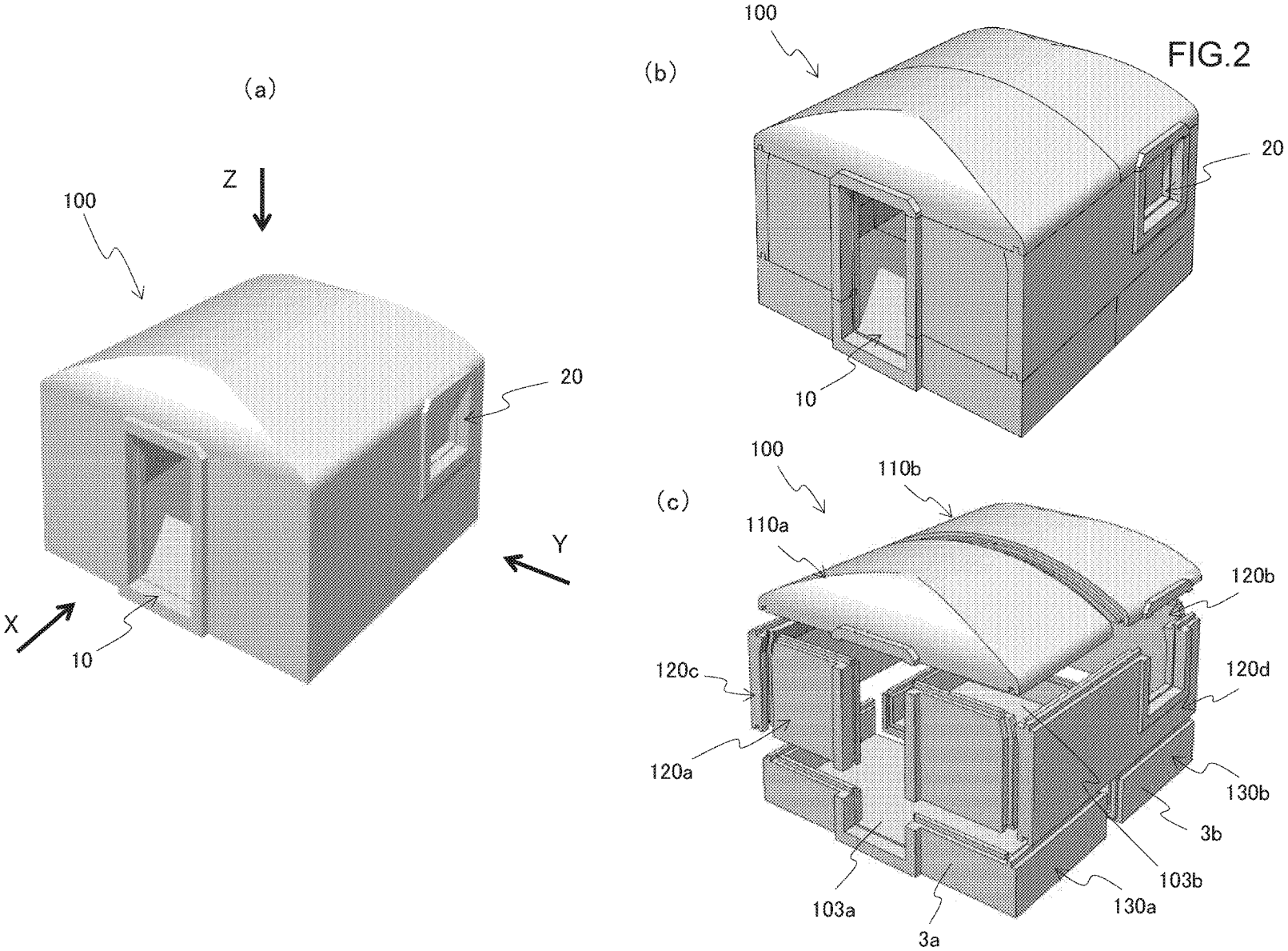
FIG. 2 is a perspective view for describing the structure 100 according to Embodiment 1 of the invention.

FIG. 2 is a diagram for describing the structure 100 according to Embodiment 1 of the invention. FIG. 2(*a*) shows the outer appearance of the structure 100. FIG. 2(*b*) shows the contour of constituent members in the structure 100 shown in FIG. 2(*a*). FIG. 2(*c*) shows the structure 100 shown in FIG. 2(*a*) separated into individual constituent members.

An entrance/exit 10 and a window 20 are formed on a wall of the structure (first structure) 100 shown in FIG. 2. In this regard, the structure 100 has two ceiling members, four wall members, and two floor members.

The two ceiling members are a front ceiling member (first ceiling member) 110*a* on the proximal side of the diagram of FIG. 2(*c*) and a back ceiling member (second ceiling member) 110*b* on the distal side of the diagram of FIG. 2(*c*).

The four wall members are a front wall member (first wall member) 120*a*, a back wall member (second wall member) 120*b*, a left wall member (third wall member) 120*c*, and a right wall member (fourth wall member) 120*d*. The front wall member 120*a* is the wall member located in front when the structure 100 is viewed from the X-direction of FIG. 2(*a*). The left wall member 120*c* and the right wall member 120*d* are located on the left and right sides of the front wall member 120*a*, respectively. The back wall member 120*b* is the wall member that is located on the back side of the structure 100 when the structure 100 is viewed from the X direction of FIG. 2(*a*).

The two floor members are a front floor member (first floor member) 130*a* on the proximal side of the diagram of FIG. 2(*c*) and a back floor member (second floor member) 130*b* on the distal side of the diagram of FIG. 2(*c*).

In this regard, each member is made of foam such as polystyrene foam (extruded polystyrene foam), and the expansion ratio of the floor members is less than the expansion ratios of the wall members and the ceiling members.

Specifically, for extruded polystyrene foam, the foam raw material is generally foamed at an expansion ratio of about 5-fold (hard with few air layers) to 90-fold (soft with many air layers). The expansion ratio of a common cooler box is about 60-fold with respect to the foam raw material.

For example, foam with a ratio (expansion ratio) of about 10-fold to about 60-fold with respect to the foam raw material is used for each member of the structure. If, for example, the expansion ratio of the lower section (floor members) of the structure is about 20-fold to about 30-fold, the expansion ratio of the upper section of the structure (wall members and ceiling members) is set to about 40-fold.

The expansion ratios of the lower section (floor members) of the structure and the upper section (wall members and ceiling members) of the structure are compared. The expansion ratio of the upper section (wall members and ceiling members) is about 1.5-fold to about 4-fold of the expansion ratio of the lower section (floor members), and more specifically about 1.5-fold to about 2-fold of the expansion ratio of the lower section (floor members).

In this regard, an expansion ratio of foam that is too low has an advantage of increasing the strength of the foam, but the foam would be heavier because a large amount of foam raw material is required. This is disadvantageous for transportation of members and results in a higher cost and difficulty in processing. Furthermore, the ratio of air contained in the members would be low, so that the heat insulation property would be lower.

In contrast, an expansion ratio of foam that is too high has advantages such as an improved heat insulation property of the foam and lower cost, but entails negative effects such as lower strength and durability of the foam.

Thus, it is necessary to use foam with the optimal expansion ratio for each member constituting the structure while considering the advantageous and disadvantageous.

The structure (first structure) 100 can float on water by forming each of the two ceiling members, four wall members, and two floor members with foam.

In such a case, the material of each part constituting the structure is the same, so that the same bonding force acts on both bonded members.

If the materials are different between bonded members such as wood and foam, steel and foam, or brick and foam, the materials often cannot be bonded with only an adhesive. Even if the materials can be bonded with an adhesive, it is highly likely that one of the members would readily come off.

For example, an adhesive that is optimal for foam is not necessarily optimal for wood. In such a case, there would be a difference in bonding forces due to an adhesive between the two bonded members. Such a difference in bonding forces affects the strength or durability of a structure. If materials are different between members constituting a structure, the strength, durability, or the like can also be affected by the coating applied to the surface of each member constituting the structure.

As foam constituting each section of a structure, polystyrene foam is a material that does not readily deteriorate and lasts for a very long period of time unless affected by a deterioration factor such as water, ultraviolet ray, chemical, or high temperature. The effect of such deterioration factors can be prevented by a coating.

The specific structure of each member is described hereinafter.

First, the first wall member to the fourth wall member are described.

Figure 3:
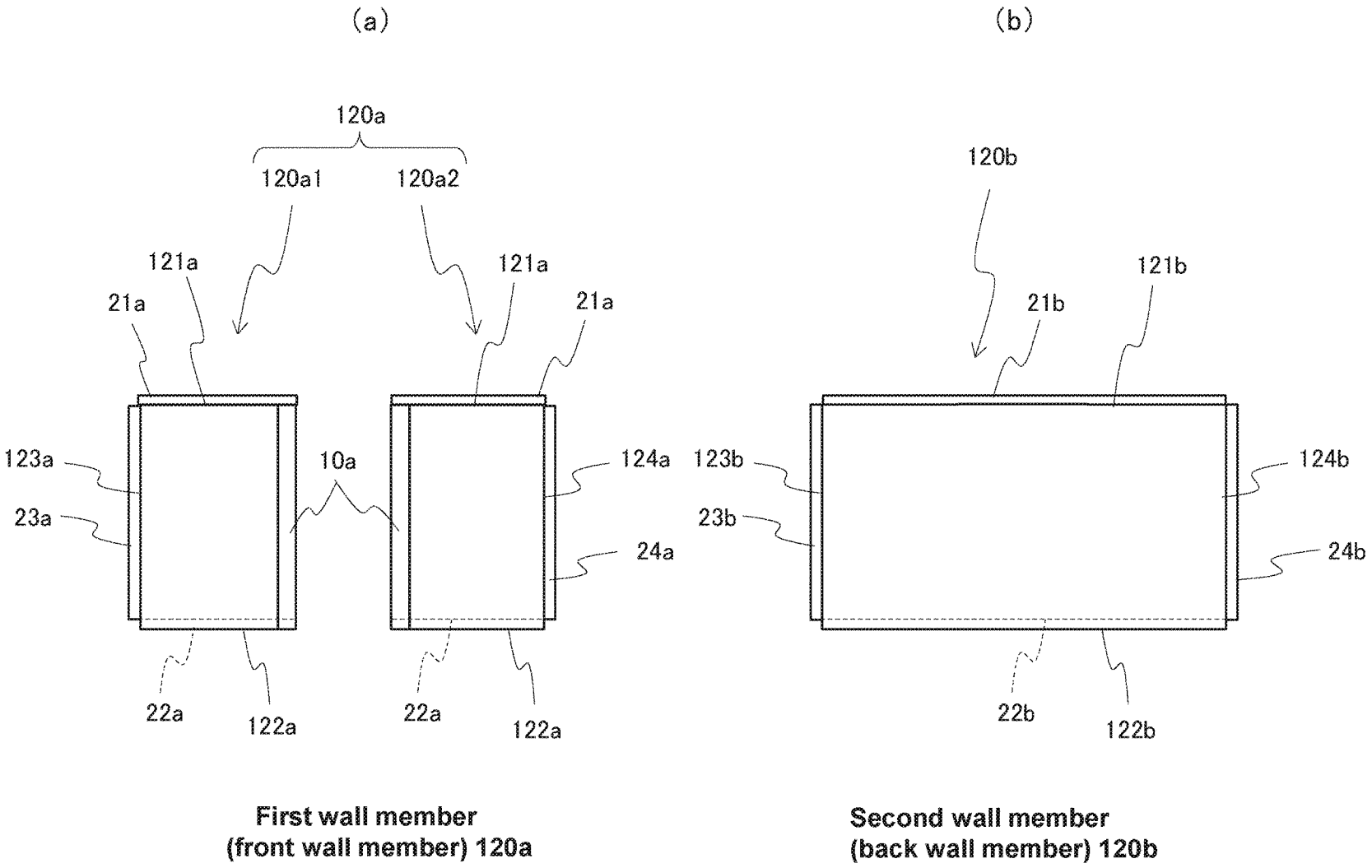
FIG. 3 is a plan view for describing the front and back wall members of the structure 100 shown in FIG. 2.

FIG. 3 is a plan view for describing the front and back wall members of the structure 100 shown in FIG. 2. FIG. 3(*a*) shows the exterior surface of the front wall member 120*a* located on the proximal side of the diagram of FIG. 2(*c*). FIG. 3(*b*) shows the exterior surface of the back wall member 120*b* located on the distal side of the diagram of FIG. 2(*c*).

(First Wall Member (Front Wall Member) 120*a*)

The front wall member 120*a* is composed of a pair of front wall members, i.e., a front wall member left fragment 120*a*1 and a front wall member right fragment 120*a*2. The top edges of the front wall member left fragment 120*a*1 and the front wall member right fragment 120*a*2 are first joint edge 121*a* that is joined to the front ceiling member 110*a*. A linear protrusion 21*a* is formed on the end surface of the top edge. The bottom edges of the front wall member left fragment 120*a*1 and the front wall member right fragment 120*a*2 are second joint edge 122*a* that is joined to the front floor member 130*a*. A linear groove 22*a* is formed on the end surface of the bottom edge.

The left edge of the front wall member left fragment 120*a*1 is a third joint edge 123*a* that is joined to the left wall member 120*c*. A linear protrusion 23*a* is formed on the end surface of the left edge. An opening frame 10*a* along an opening forming the entrance/exit 10 is formed on the right side edge of the front wall member left fragment 120*a*1.

The right edge of the front wall member right fragment 120*a*2 is a fourth joint edge 124*a* that is joined to the right wall member 120*d*. A linear protrusion 24*a* is formed on the end surface of the right edge. An opening frame 10*a* along an opening forming the entrance/exit 10 is formed on the left side edge of the front wall member right fragment 120*a*2.

The front wall member 120*a* has a height of about 1.5 m and a width of about 4 m, and the size of the entrance/exit 10 has a height of about 2 m and a width of about 1 m. However, the dimension of the front wall member 120*a* is not limited thereto. Any size that can be transported by a vehicle such as a truck and can be carried by humans does not pose any practical problem.

(Second Wall Member (Back Wall Member) 120*b*)

The top side edge of the back wall member 120*b* is a second joint edge 121*b* that is joined to the back ceiling member 110*b*. A linear protrusion 21*b* is formed on the end surface of the top edge.

The bottom edge of the back wall member 120*b* is a second joint edge 122*b* that is joined to the back floor member 130*b*. A linear groove 22*b* is formed on the end surface of the bottom edge.

The left edge of the back wall member 120*b* is a third joint edge 123*b* that is joined to the right wall member 120*d*. A linear protrusion 23*b* is formed on the end surface of the left edge.

The right edge of the back wall member 120*b* is a fourth joint edge 124*b* that is joined to the left wall member 120*c*. A linear protrusion 24*b* is formed on the end surface of the right edge.

The back wall member 120*b* has the same height (about 1.5 m) and width (about 4 m) as the front wall member 120*a*.

Figure 4:
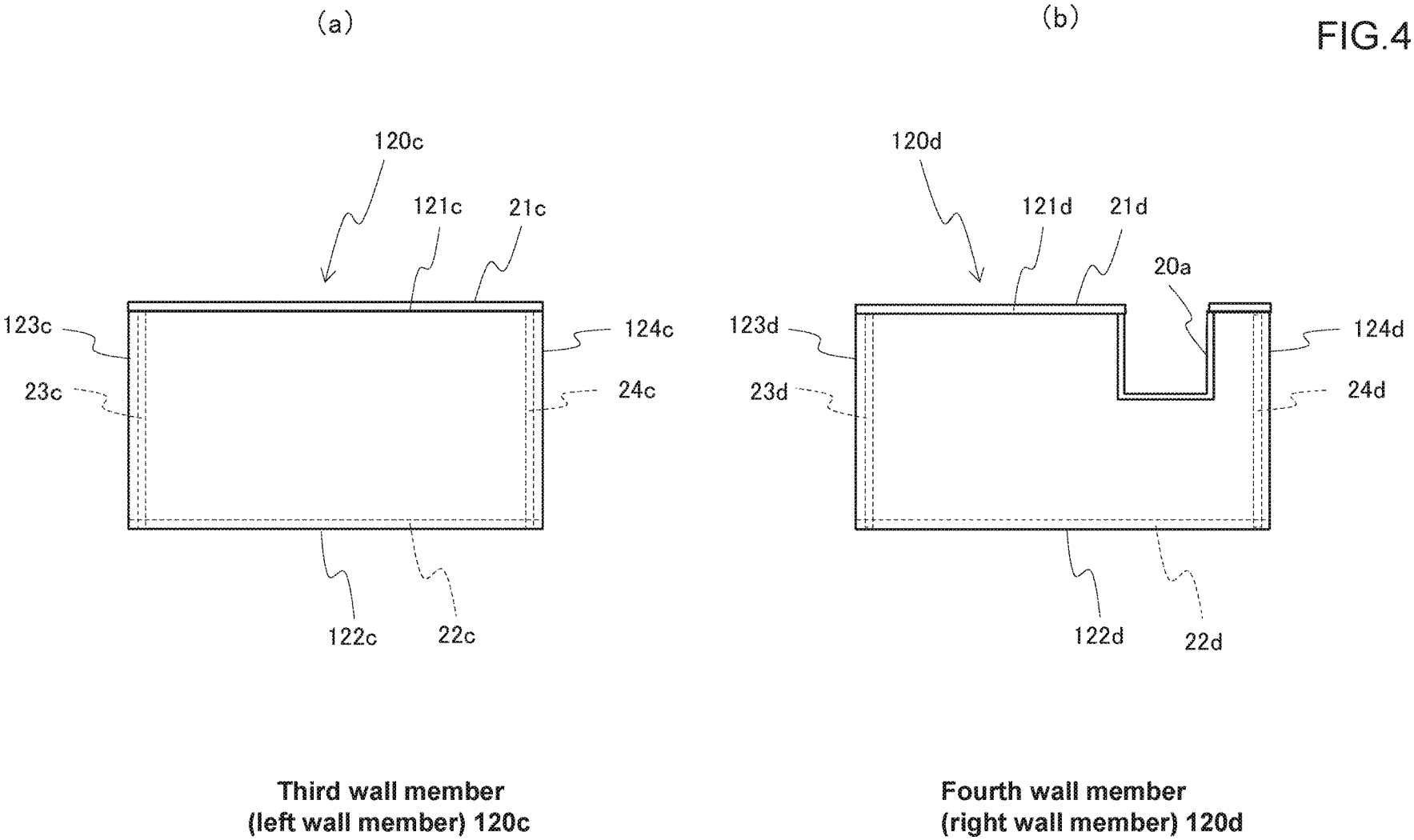
FIG. 4 is a plan view for describing the left and right wall members of the structure 100 shown in FIG. 2.

FIG. 4 is a plan view for describing the side wall member of the structure 100 shown in FIG. 2. FIG. 4(*a*) shows the exterior surface of the side wall member (left wall member) 120*c* located on the left side of the diagram of FIG. 2(*c*). FIG. 4(*b*) shows the exterior surface of the side wall member (right wall member) 120*d* located on the right side of the diagram of FIG. 2(*c*).

(Third Wall Member (Left Wall Member 120*c*)

The top edge of the left wall member 120*c* is a first joint edge 121*c* that is joined to the front ceiling member 110*a* and the back ceiling member 110*b*. A linear protrusion 21*c* is formed on the end surface of the top edge.

The bottom edge of the left wall member 120*c* is a second joint edge 122*c* that is joined to the front floor member 130*a* and the back floor member 130*b*. A linear groove 22*c* is formed on the end surface of the bottom edge.

The left edge of the left wall member 120*c* is a third joint edge 123*c* that is joined to the back wall member 120*b*. A linear groove 23*c* is formed on the inside surface of the left edge.

The right edge of the left wall member 120*c* is a fourth joint edge 124*c* that is joined to the front wall member 120*a*. A linear groove 24*c* is formed on the inside surface of the right edge.

The left wall member 120*c* has a height of about 1.5 m and a length of about 4 m. However, the dimensions of the left wall member 120*c* are not limited thereto. Any size that can be transported by a vehicle such as a truck and can be carried by humans does not pose any practical problem.

(Fourth Wall Member (Right Wall Member) 120*d*)

The top edge of the right wall member 120*d* is a first joint edge 121*d* that is joined to the front ceiling member 110*a* and the back ceiling member 110*b*. A linear protrusion 21*d* is formed on the end surface of the top edge. A window frame 20*a* is formed along a notched section that would be a window on the right wall member 120*d*.

The bottom edge of the right wall member 120*d* is a second joint edge 122*d* that is joined to the front floor member 130*a* and the back floor member 130*b*. A linear groove 22*d* is formed on the end surface of the bottom edge.

The left edge of the right wall member 120*d* is a third joint edge 123*d* that is joined to the front wall member 120*a*. A linear groove 23*d* is formed on the inside surface of the left edge.

The right edge of the right wall member 120*d* is a fourth joint edge 124*d* that is joined to the back wall member 120*b*. A linear groove 24*d* is formed on the inside surface of the right edge.

The right wall member 120*d* has the same height of about 1.5 m and length of about 4 m as the left wall member 120*c*. A notched portion for forming a window has dimensions of about 900 mm in height and about 1000 mm in width. However, the dimensions of the notched portion for forming a window are determined by the size of the window, and can be freely determined within the range of the height and length of the right wall member 120*d*.

Figure 5:
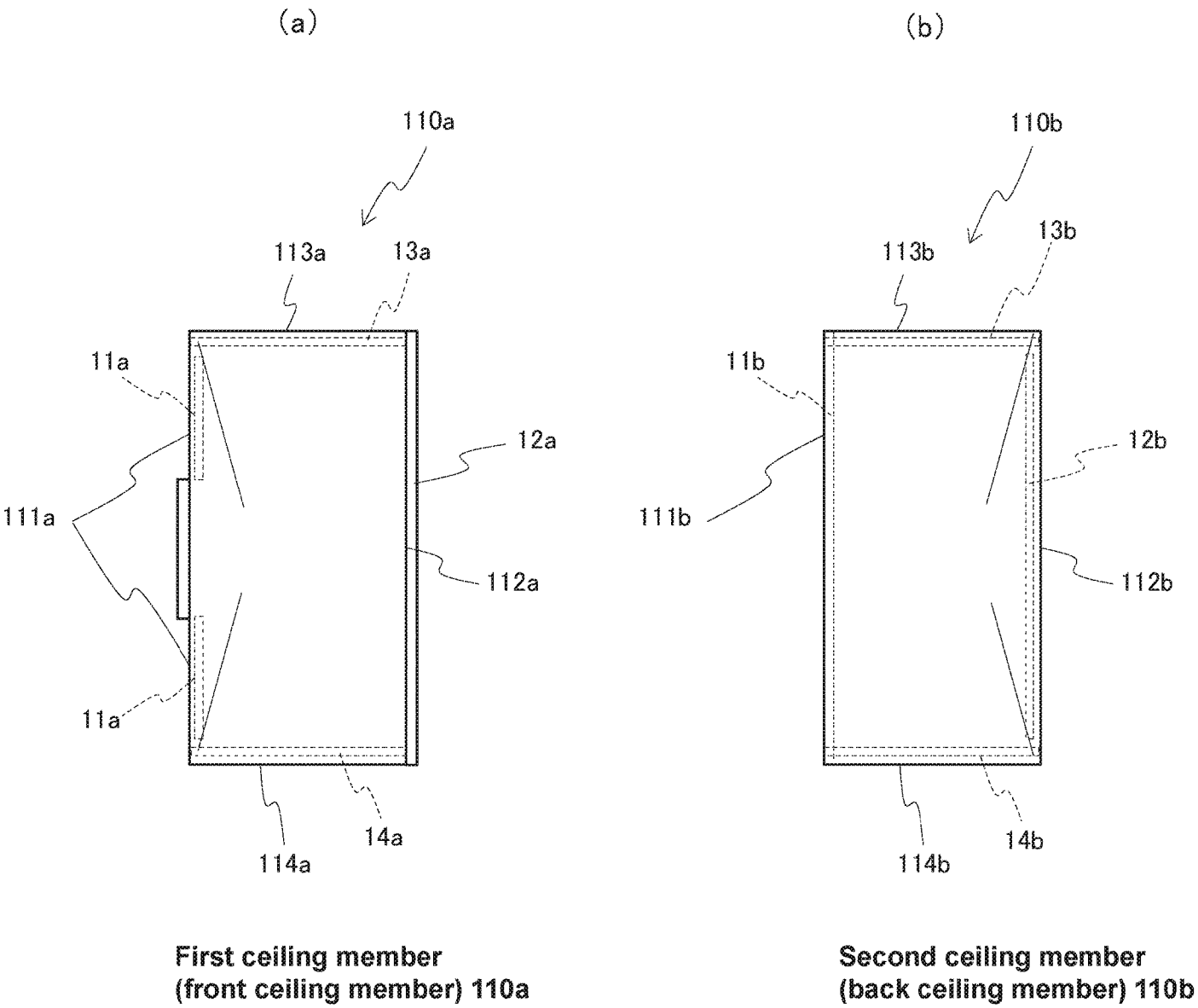
FIG. 5 is a plan view for describing the front and back ceiling members of the structure 100 shown in FIG. 2.

FIG. 5 is a plan view for describing the ceiling members of the structure 100 shown in FIG. 2. FIG. 5(*a*) shows the structure of the front ceiling member 110*a* located on the proximal side of the diagram of FIG. 2(*c*) when viewed from the top. FIG. 5(*b*) shows the structure of the back ceiling member 110*b* located on the distal side of the diagram of FIG. 2(*c*) when viewed from the top.

(First Ceiling Member (Front Ceiling Member) 110*a*)

The front edge of the front ceiling member 110*a* is a first joint edge 111*a* that is joined to the front wall member 120*a*. A linear groove 11*a* is formed on the bottom side surface of the front edge.

The back edge of the front ceiling member 110*a* is a second joint edge 112*a* that is joined to the back ceiling member 110*b*. A linear protrusion 12*a* is formed on the end surface of the back edge.

The left edge of the front ceiling member 110*a* is a third joint edge 113*a* that is joined to the left wall member 120*c*. A linear groove 13*a* is formed on the bottom side surface of the left edge.

The right edge of the front ceiling member 110*a* is a fourth joint edge 114*a* that is joined to the right wall member 120*d*. A linear groove 14*a* is formed on the bottom side surface of the right edge.

The front ceiling member 110*a* has a width of about 4 m and a length (dimension toward the depth direction) of about 2 m. However, the dimension is not limited thereto. Any size that can be transported by a vehicle such as a truck does not pose any practical problem.

(Second Ceiling Member (Back Ceiling Member) 110*b*)

The front edge of the back ceiling member 110*b* is a first joint edge 111*b* that is joined to the front ceiling member 110*a*. A linear groove 11*b* is formed on the end surface of the front edge.

The back edge of the back ceiling member 110*b* is a second joint edge 112*b* that is joined to the back wall member 120*b*. A linear groove 12*b* is formed on the bottom side surface of the back edge.

The left edge of the back ceiling member 110*b* is a third joint edge 113*b* that is joined to the left wall member 120*c*. A linear groove 13*b* is formed on the bottom side surface of the left edge.

The right edge of the back ceiling member 110*b* is a fourth joint edge 114*b* that is joined to the right wall member 120*d*. A linear groove 14*b* is formed on the bottom side surface of the right edge.

Figure 6:
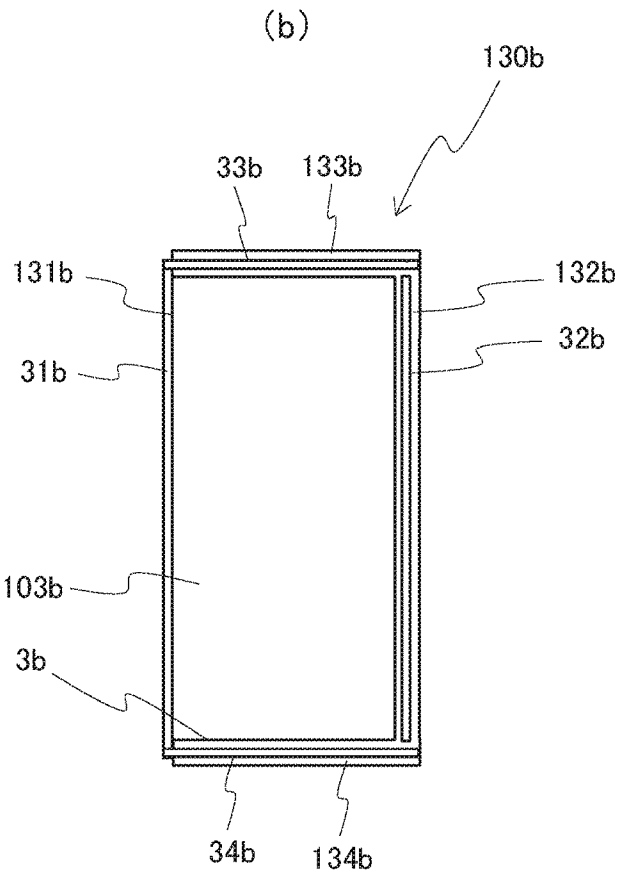
FIG. 6 is a plan view for describing the front and back floor members of the structure 100 shown in FIG. 2.
Figure 6:
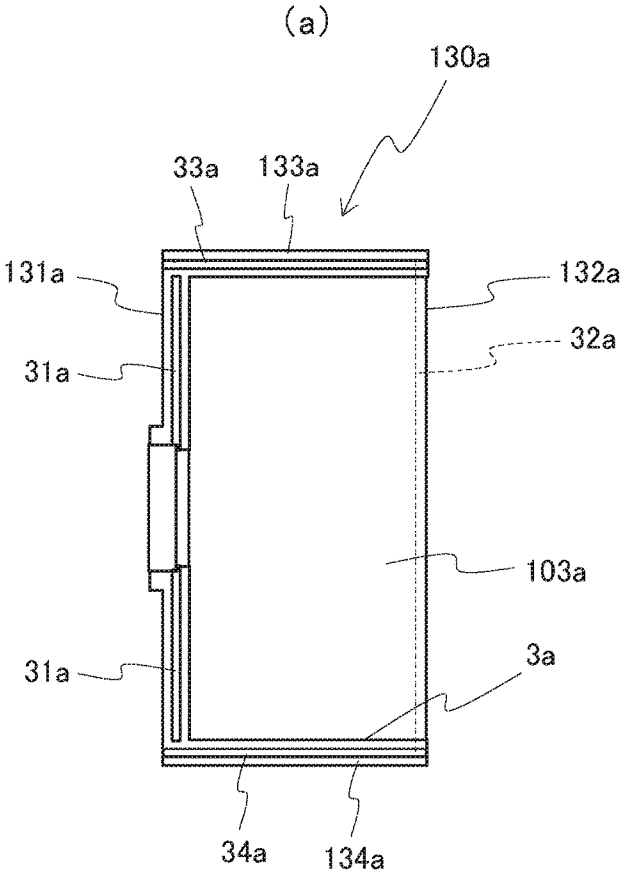

FIG. 6 is a plan view for describing the floor members of the structure 100 shown in FIG. 2. FIG. 6(*a*) shows the structure of the front floor member 130*a* located on the proximal side of the diagram of FIG. 2(*c*) when viewed from the top. FIG. 6(*b*) shows the structure of the back floor member 130*b* located on the distal side of the diagram of FIG. 2(*c*) when viewed from the top.

(First Floor Member (Front Floor Member 130*a*))

The front floor member 130*a* has a rectangular floor board 103*a* and C-shaped wainscoting 3*a* raised to surround the floor board 103*a* from the front edge, left edge, and right edge of the floor board. The floor board 103*a* and the wainscoting 3*a* are integrally formed without a joint.

The top edge of the front edge section of the wainscoting 3*a* is a first joint edge 131*a* connected to the front wall member 120*a*. A linear protrusion 31*a* is formed to be located on both sides of a notched section forming the entrance/exit 10 at the top edge.

In this regard, the notched section forming the entrance/exit 10 is a portion that is notched from the top end of the wainscoting 3*a*. At the entrance/exit 10, the height of the wainscoting 3*a* is lower compared to other portions (portions where the entrance/exit 10 is not provided), or the wainscoting 3*a* is completely removed. For this reason, the entrance/exit 10 can be a path from which water can infiltrate when the structure 100 is installed on water. For example, the entrance/exit 10 can be configured so that the depth of the notched section forming the entrance/exit 10 can be made as shallow as possible or such a notched section is not formed, or a barrier that blocks at least a part of the notched section can be provided. This can prevent infiltration of water from the entrance/exit 10. Alternatively, at a portion of the front floor member 130*a* where the entrance/exit 10 is formed, a barrier for preventing infiltration of water can be provided on the wainscoting 3*a* in contrast to forming a notched section on the wainscoting 3*a*.

In any case, it is preferable to secure a height of at least about 20 cm to about 30 cm from the bottom surface of the front floor member 130*a*, at the portion of the front floor member 130*a* where the entrance/exit 10 is formed, as the height of the wainscoting 3*a* when a notched section is formed at the wainscoting 3*a*, the height of a barrier when a notched section of the wainscoting 3*a* is blocked with the barrier, the height of the wainscoting 3*a* when a notched section is not formed at the wainscoting 3*a*, or the total height of the wainscoting 3*a* and a barrier section formed thereon.

The back edge of the front floor member 130*a* is a second joint edge 132*a* that is joined to the back floor member 130*b*. A linear groove 32*a* is formed on the end surface of the back side edge. Specifically, the second joint edge 132*a* of the front floor member 130*a* is composed of the back edge of the floor board 103*a* and the back edge of the wainscoting 3*a*. The linear groove 32*a* is formed to span the end surface of the back edge of the floor board 103*a* and the end surface of the back edge of the wainscoting 3*a*.

Further, the top edge of the left side section of the wainscoting 3*a* is a third joint edge 133*a* that is connected to the left wall member 120*c*. A linear protrusion 33*a* is formed on the top edge.

The top edge of the right side section of the wainscoting 3*a* is a fourth joint edge 134*a* that is connected to the right wall member 120*d*. A linear protrusion 34*a* is formed on the top edge.

A floor member has a width of about 4 m and a length (dimension in the depth direction) of about 2 m. The height of the wainscoting is about 650 mm.

However, the dimensions (width and length) of the floor member 130*a* are not limited thereto. Any size that can be transported by a vehicle such as a truck and can be carried by humans does not pose any practical problem. While the height of the wainscoting is not limited, the height is at most about 800 mm because loading would be challenging upon transport if the wainscoting is too high. If the height of the wainscoting is too low at an entrance/exit, the risk of infiltration of water above floor level upon flooding increases, so that a height of at least about 200 mm needs to be secured.

(Second Floor Member (Back Floor Member 130*b*))

The back floor member 130*b* has a rectangular floor board 103*b* and C-shaped wainscoting 3*b* raised to surround the floor board 103*b* from the back edge, left edge, and right edge of the floor board. The floor board 103*b* and the wainscoting 3*b* are integrally formed without a joint.

The front edge of the back floor member 130*b* is a first joint edge 131*b* that is connected to the front floor member 130*a*. A linear protrusion 31*b* is formed on the end surface of the front side edge. Specifically, the first joint edge 131*b* of the back floor member 130*b* is composed of the front edge of the floor board 103*b* and the front edge of the wainscoting 3*b*. The linear protrusion 31*b* is formed to span the end surface of the front edge of the floor board 103*b* and the end surface of the front edge of the wainscoting 3*b*.

The top edge of the back edge section of the wainscoting 3*b* is a second joint edge 132*b* that is joined to the back wall member 120*b*. A linear protrusion 32*b* is formed on the end surface of the back side edge.

The top edge of the left side section of the wainscoting 3*b* is a third joint edge 133*b* that is connected to the left wall member 120*c*. A linear protrusion 33*b* is formed on the top edge.

The top edge of the right side section of the wainscoting 3*b* is a fourth joint edge 134*b* that is connected to the right wall member 120*d*. A linear protrusion 34*b* is formed on the top edge.

The dimensions of the back floor member 130*b* are the same as the dimensions of the front floor member 130*a*.

The structure of the structure 100 assembled with each of the members described above is now described using a cross-sectional view.

Figure 7:
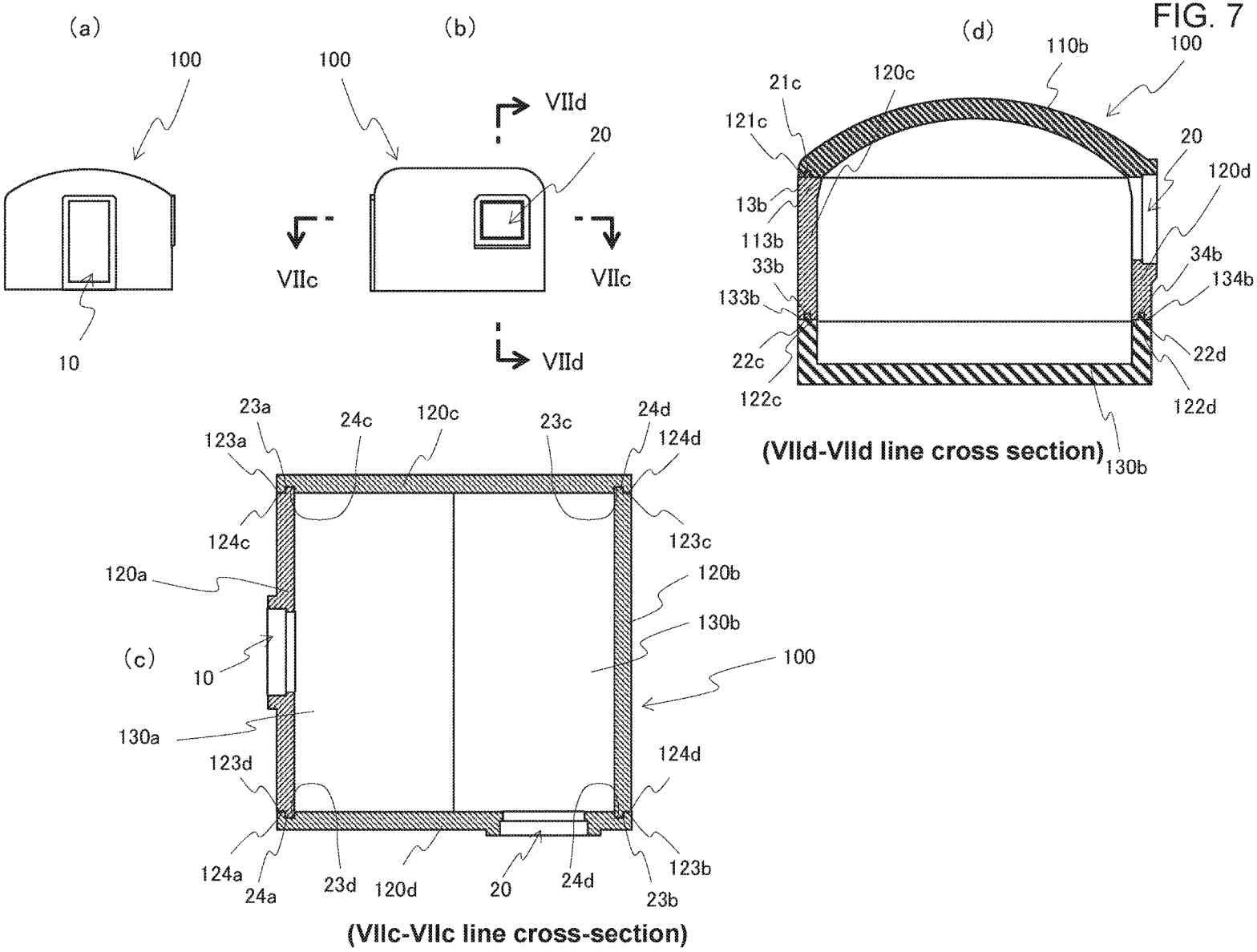
FIG. 7 is a diagram for describing the specific structure of the structure 100 shown in FIG. 2. The figure shows the structure of the cross-section that is perpendicular to the Z direction of FIG. 2 and the structure of the cross-section that is perpendicular to the X direction of FIG. 2 in the structure 100.

FIG. 7 is a diagram for describing the specific structure of the structure 100 shown in FIG. 2(*a*). FIG. 7(*a*) is a side view showing the structure of the structure 100 shown in FIG. 2(*a*) when viewed from the X direction. FIG. 7(*b*) is a side view showing the structure of the structure 100 shown in FIG. 2(*a*) when viewed from the Y direction. FIG. 7(*c*) is a cross-sectional view at the VIIc-VIIc line in FIG. 7(*b*). FIG. 7(*d*) is a cross-sectional view at the VIId-VIId line in FIG. 7(*b*).

FIG. 7(*c*) shows that adjacent wall members among the four wall members are joined with each other at opposing joint edges.

Specifically, the third joint edge 123*a* of the front wall member 120*a* is joined to the fourth joint edge 124*c* of the left wall member 120*c*, and the linear protrusion 23*a* formed on the end surface of the third joint edge 123*a* is fitted with the linear groove 24*c* formed on the inside surface of the fourth joint edge 124*c*.

The fourth joint edge 124*a* of the front wall member 120*a* is joined to the third joint edge 123*d* of the right wall member 120*d*, and the linear protrusion 24*a* formed on the end surface of the fourth joint edge 124*a* is fitted with the linear groove 23*d* formed on the inside surface of the third joint edge 123*d*.

The third joint edge 123*b* of the back wall member 120*b* is joined to the fourth joint edge 124*d* of the right wall member 120*d*, and the linear protrusion 23*b* formed on the end surface of the third joint edge 123*b* is fitted with the linear groove 24*d* formed on the inside surface of the fourth joint edge 124*d*.

The fourth joint edge 124*b* of the back wall member 120*b* is joined to the third joint edge 123*c* of the left wall member 120*c*, and the linear protrusion 24*b* formed on the end surface of the fourth joint edge 124*b* is fitted with the linear groove 23*c* formed on the inside surface of the third joint edge 123*b*.

FIG. 7(*d*) shows that the left wall member 120*c* and the right wall member 120*d* are connected to the back ceiling member 110*b* and the back floor member 130*b*.

Specifically, the first joint edge 121*c* of the left wall member 120*c* is joined to the third joint edge 113*b* of the back ceiling member 110*b*, and the linear protrusion 21*c* formed on the end surface of the first joint edge 121*c* is fitted with the linear groove 13*b* formed on the end surface of the third joint edge 113*b*.

The second joint edge 122*c* of the left wall member 120*c* is joined to the third joint edge 133*b* of the back floor member 130*b*, and the linear groove 22*c* formed on the end surface of the second joint edge 122*c* is fitted with the linear protrusion 33*b* formed on the end surface of the third joint edge 133*b*.

The second joint edge 122*d* of the right wall member 120*d* is joined to the fourth joint edge 134*b* of the back floor member 130*b*, and the linear groove 22*d* formed on the end surface of the second joint edge 122*d* is fitted with the linear protrusion 134*b* formed on the end surface of the fourth joint edge 134*b*.

Figure 8:
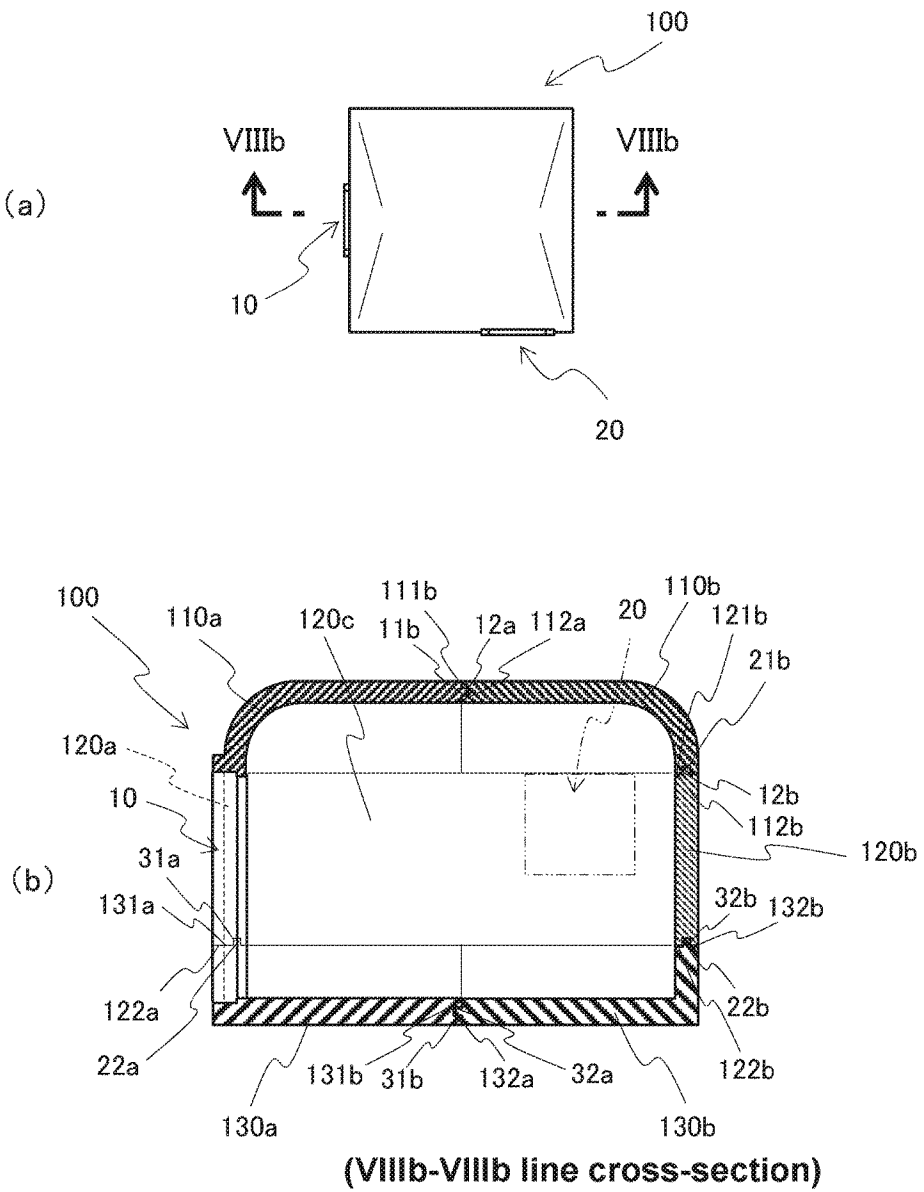
FIG. 8 is a diagram for describing the specific structure of the structure 100 shown in FIG. 2. The figure shows the structure of the cross-section that is perpendicular to the Y direction of FIG. 2 in the structure 100.

FIG. 8 is a diagram for describing the specific structure of the structure 100 shown in FIG. 2. FIG. 8(*a*) is a plan view showing the structure of structure 100 shown in FIG. 2(*a*) when viewed from the Z direction. FIG. 8(*b*) is a cross-sectional view at the VIIIb-VIIIb line of FIG. 8(*a*).

FIG. 8(*b*) shows the joined state of the front ceiling member 110*a* and the back ceiling member 110*b*, the joint state of the front floor member 130*a* and the back floor member 130*b*, the joined state of the front wall member 120*a* and the front floor member 130*a*, and the joined state of the back wall member 120*b* and the back ceiling member 110*b* and the back floor member 130*b*.

Specifically, the second joint edge 122*a* of the front wall member 120*a* is joined to the first joint edge 131*a* of the front floor member 130*a*, and the linear groove 22*a* formed on the end surface of the second joint edge 122*a* is fitted with the linear protrusion 31*a* formed on the end surface of the first joint edge 131*a*.

The first joint edge 121*b* of the back wall member 120*b* is joined to the second joint edge 112*b* of the back ceiling member 110*b*, and the linear protrusion 21*b* formed on the end surface of the first joint edge 121*b* is fitted with the linear groove 12*b* formed on the end surface of the second joint edge 112*b*.

The second joint edge 122*b* of the back wall member 120*b* is joined to the second joint edge 132*b* of the back floor member 130*b*, and the linear groove 22*b* formed on the end surface of the second joint edge 122*b* is fitted with the linear protrusion 32*b* formed on the end surface of the second joint edge 132*b*.

The second joint edge 112*a* of the front ceiling member 110*a* is joined to the first joint edge 111*b* of the back ceiling member 110*b*, and the linear protrusion 12*a* formed on the end surface of the second joint edge 112*a* is fitted with the linear groove 11*b* formed on the end surface of the first joint edge 111*b*.

The second joint edge 132*a* of the front floor member 130*a* is joined to the first joint edge 131*b* of the back floor member 130*b*, and the linear groove 32*a* formed on the end surface of the second joint edge 132*a* is fitted with the linear protrusion 31*b* formed on the end surface of the first joint edge 131*b* of the back floor member 130*b*.

As described in FIGS. 7 and 8, adjacent members of the plurality of members constituting the structure 100 of Embodiment 1 are joined by fitting a linear protrusion formed on one of the opposing joint edges of the adjacent members with a linear groove formed on the other opposing joint edge of the adjacent members. Further, joint edges of adjacent members are bonded with an adhesive. The adhesive can be any adhesive that is capable of bonding foam. Examples of the adhesive include, but are not limited to, one-component urethane resin adhesives. Any adhesive that is free of a solvent which dissolves foam can be used. One-component adhesives are preferable over two-component mixture adhesives because one-component adhesives are overwhelmingly advantageous in terms of processing time when applying an adhesive to a wide surface that is bonded, such as the surface of each section of a structure.

The shape of a joint section is not limited to the aforementioned linear protrusions and linear grooves. A joint section can have any other shape.

Modification Example of Embodiment 1

The structure 100 of Embodiment 1 described above uses wall members with a size (length in the depth direction of structure 100) that spans the front and back ceiling members (or front and back floor members) as left and right wall members (left wall member 120*c* and right wall member 120*d*), but the size of the wall members used in the structure 100 of Embodiment 1 is not limited to a size that spans the front and back ceiling members (or front and back floor members).

Figure 9:
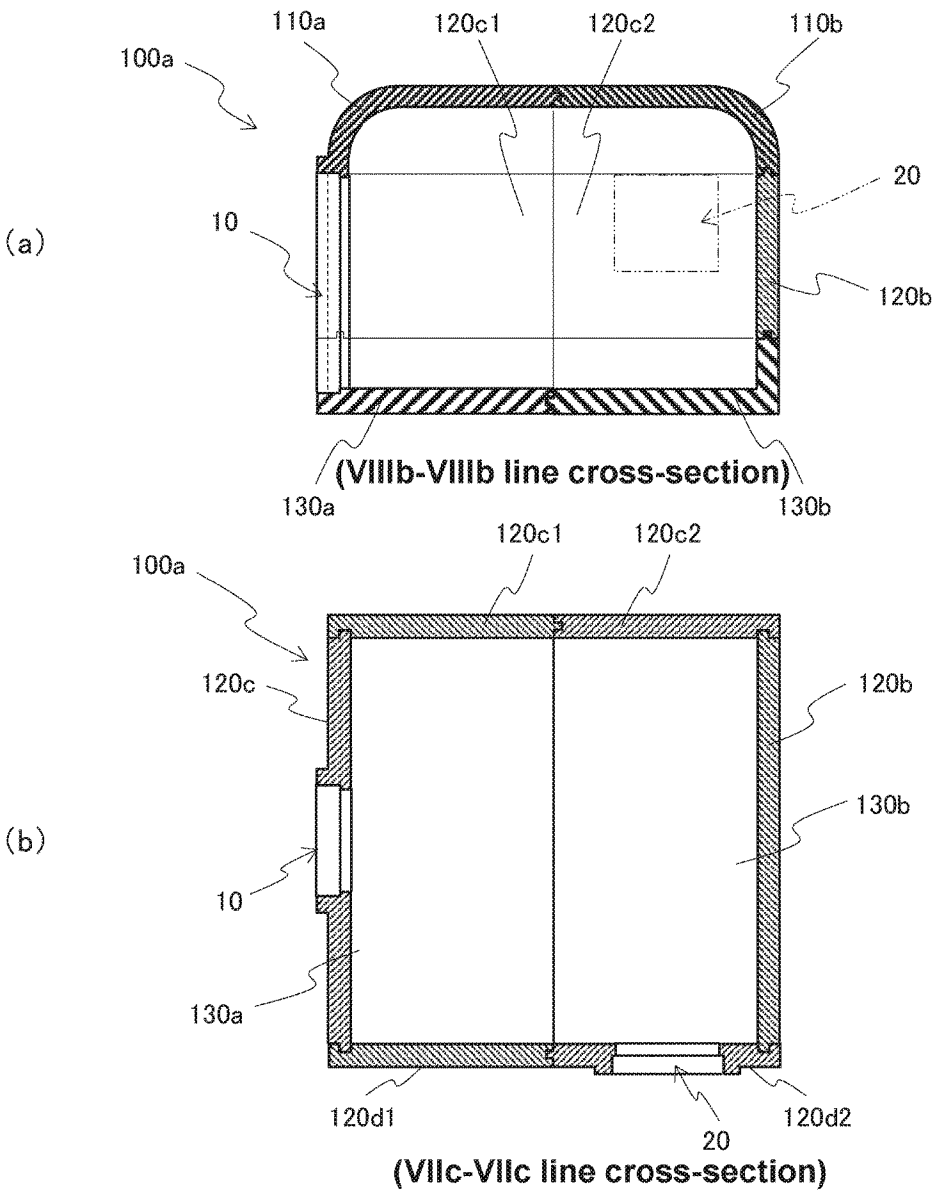
FIG. 9 is a diagram for describing structure 100*a*, which is Modification Example 1 of the structure 100 shown in FIG. 2.

FIG. 9 is a diagram for describing structure 100*a*, which is Modification Example 1 of the structure 100 shown in FIG. 2(*a*). FIG. 9(*a*) shows the structure of the structure 100*a* at the cross-section corresponding to the cross-sectional view at the VIIIb-VIIIb line shown in FIG. 8(*a*). FIG. 9(*b*) shows the structure of the structure 100*a* at the cross-section at the VIIc-VIIc line shown in FIG. 7(*c*).

The structure 100*a* in Modification Example 1 replaces the left wall member 120*c* in the structure 100 of Embodiment 1 with two short left wall members 120*c*1 and 120*c*2 obtained by dividing the left wall member 120*c* in two at a division line along the direction of width (up and down directions in the diagram of FIG. 9(*b*)) and replaces the right wall member 120*d* in the structure 100 of Embodiment 1 with two short right wall members 120*d*1 and 120*d*2 obtained by dividing the right wall member 120*d* in two at the above division line. The lengths (dimension in the depth direction) of the short left wall member 120*c*1 and the short right wall member 120*d*1 are equal to the dimension in the depth direction as the front ceiling member 110*a*, and the lengths (dimension in the depth direction) of short left wall member 120*c*2 and the short right wall member 120*d*2 are equal to the dimension in the depth direction of the back ceiling member 110*b*.

A method of assembling the structure 100 by combining two ceiling members, four wall members, and two floor members detailed above is now described.

Figure 10:
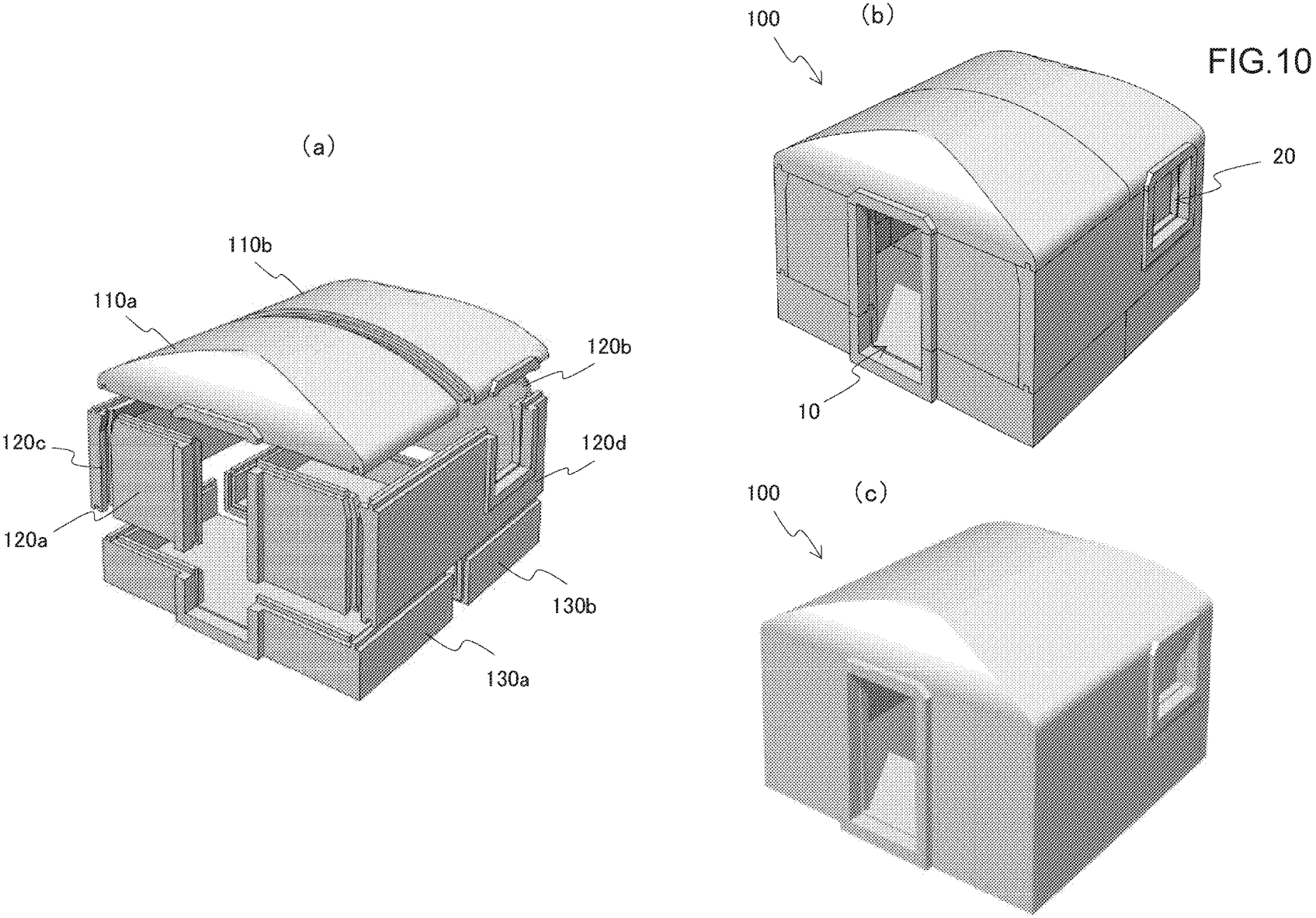
FIG. 10 is a perspective view for describing a method of assembling the structure 100 shown in FIG. 2 in the order of fabrication steps.

FIG. 10 is a perspective view for describing a method of assembling the structure 100 shown in FIG. 2 in the order of fabrication steps. FIG. 10(*a*) shows an arrangement of a plurality of constituent members when assembling the structure 100. FIG. 10(*b*) shows a plurality of constituent members that are joined. Figure shows a plurality of joined constituent members, which has been coated.

First, the front ceiling member 110*a* and the back ceiling member 110*b* are provided as two ceiling members. The front wall member 120*a*, the back wall member 120*b*, the left wall member 120*c*, and the right wall member 120*d* are provided as four wall members. The front floor member 130*a* and the back floor member 130*b* are provided as two floor members. Each member is made of foam.

The second joint edge 132*a* of the front floor member 130*a* is then joined to the first joint edge 131*b* of the back floor member 130*b*.

Subsequently, the second joint edge 122*a* of the front wall member 120*a* is joined to the first joint edge 131*a* of the front floor member 130*a*, and the second joint edge 122*b* of the back wall member 120*b* is joined to the second joint edge 132*b* of the back floor member 130*b*.

For example, the second joint edge 122*c* of the left wall member 120*c* is then joined to span the third joint edge 133*a* of the front floor member 130*a* and the third joint edge 133*b* of the back floor member 130*b*. Furthermore, the third joint edge 123*c* of the left wall member 120*c* is joined to the fourth joint edge 124*b* of the back wall member 120*b*, and the fourth joint edge 124*c* of the left wall member 120*c* is joined to the third joint edge 123*a* of the front wall member 120*a*.

Subsequently, the second joint edge 122*d* of the right wall member 120*d* is joined to span the fourth joint edge 134*a* of the front floor member 130*a* and the fourth joint edge 134*b* of the back floor member 130*b*. Furthermore, the third joint edge 123*d* of the right wall member 120*d* is joined to the fourth joint edge 124*a* of the front wall member 120*a*, and the fourth joint edge 124*d* of the right wall member 120*d* is joined to the third joint edge 123*b* of the back wall member 120*b*.

The front ceiling member 110*a* is then placed on the front wall member 120*a*, the left wall member 120*c*, and the right wall member 120*d* to join the first joint edge 111*a* of the front ceiling member 110*a* to the first joint edge 121*a* of the front wall member 120*a*, join the third joint edge 113*a* of the front ceiling member 110*a* to the first joint edge 121*c* of the left wall member 120*c*, and join the fourth joint edge 114*a* of the front ceiling member 110*a* to the first joint edge 121*d* of the right wall member 120*d*.

The back ceiling member 110*b* is then placed on the back wall member 120*b*, the left wall member 120*c*, and the right wall member 120*d* to join the first joint edge 111*b* of the back ceiling member 110*b* to the second joint edge 112*a* of the front ceiling member 110*a*, join the third joint edge 113*b* of the back ceiling member 110*b* to the first joint edge 121*c* of the left wall member 120*c*, and join the fourth joint edge 114*b* of the back ceiling member 110*b* to the first joint edge 121*d* of the right wall member 120*d*, and lastly join the second joint edge 112*b* of the back ceiling member 110*b* to the first joint edge 121*b* of the back wall member 120*b*.

In this regard, when a joint edge of each member is joined to a joint edge of another opposing member, an adhesive is applied to the opposing joint edges, and a linear protrusion of one of the opposing joint edges is fitted with a linear groove of the other opposing joint edge.

In this manner, the structure 100 shown in FIG. 10(*b*) can be assembled.

The structure 100 with inconspicuous joints of constituent members as shown in FIG. 10(*c*) can then be obtained by applying a coating to the surface of the assembled structure 100 using urethane resin or the like, and applying paint finishing.

Since the structure 100 of Embodiment 1 can be assembled by combining the two ceiling members 110*a* and 110*b*, the four wall members 120*a* to 120*d*, and the two floor members 130*a* and 130*b* in this manner, the structure can be transported in a preassembled state of the structure, i.e., in a state of individual constituent members that are readily transported together. Specifically, the structure 100 has an advantageous of enabling the structure 100 to be transported in a compact form. The transport method is specifically described below.

Figure 10A:
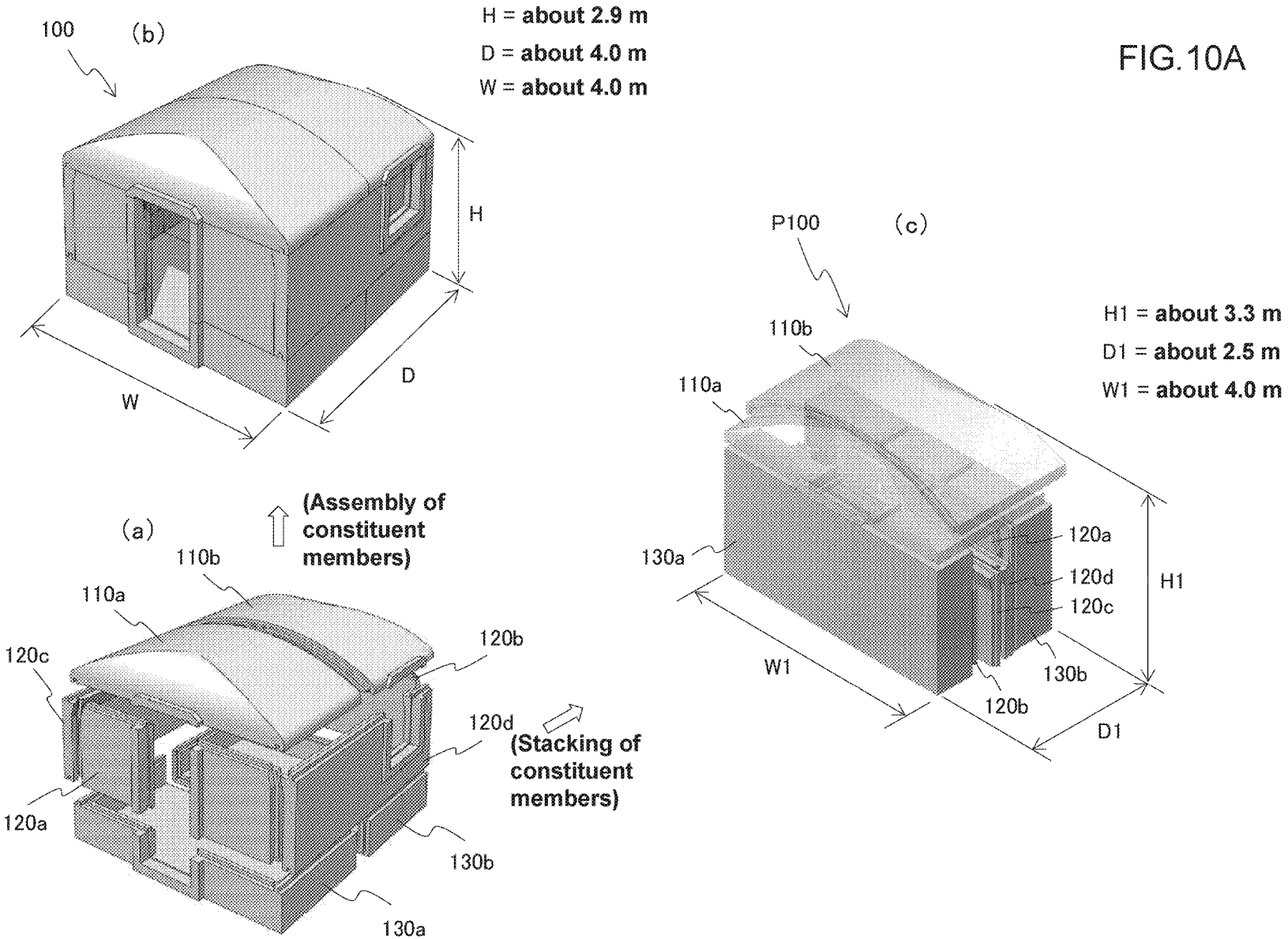
FIG. 10A is a perspective view showing a comparison of the structure 100 shown in FIG. 2 in an assembled state with constituent members of the structure 100 in a compactly stacked state.

FIG. 10A is a perspective view showing a comparison of the structure 100 shown in FIG. 2 in an assembled state with constituent members of the structure 100 in a compactly stacked state. FIG. 10A(a) shows individual constituent members of the structure 100. FIG. 10A(b) shows exemplary dimensions of the outer shape of the assembled structure 100. FIG. 10A(c) shows exemplary dimensions of the outer shape of individual constituent members of the structure 100 that are compactly stacked.

In this regard, the structure 100 obtained by assembling the six constituent members 110*a*, 110*b*, and 120*a* to 120*d* and 130*a* and 130*b* (see FIG. 10A(a)) has dimensions of width (W=about 4.0 m), depth (D=about 4.0 m), and height (H=about 2.9 m) as shown in FIG. 10A(b).

In contrast, stack P100 obtained by compactly stacking the six constituent members 110*a*, 110*b*, and 120*a* to 120*d* and 130*a* and 130*b* (see FIG. 10A(a)) has dimensions of width (W1=about 4.0 m), depth (D1=about 2.5 m), and height (H1=about 3.3 m) as shown in FIG. 10A(c).

In the stack P100, the pair of floor members 130*a* and 130*b* is erected in an opposing state so as to be long sideways. The four front, back, left, and right wall members 120*a* to 120*d* are sandwiched between the floor members 130*a* and 130*b*, and the front and back ceiling members 110*a* and 110*b* are stacked and disposed on the pair of floor members 130*a* and 130*b*.

Dimension D1 in the depth direction of the bottom surface of the stack P100 is shorter than dimension D in the depth direction of the assembled structure 100 by stacking the constituent members of the structure 100 in this manner, thus facilitating loading thereof onto the bed of a freight transport vehicle such as a truck or a trailer.

Figure 10B:
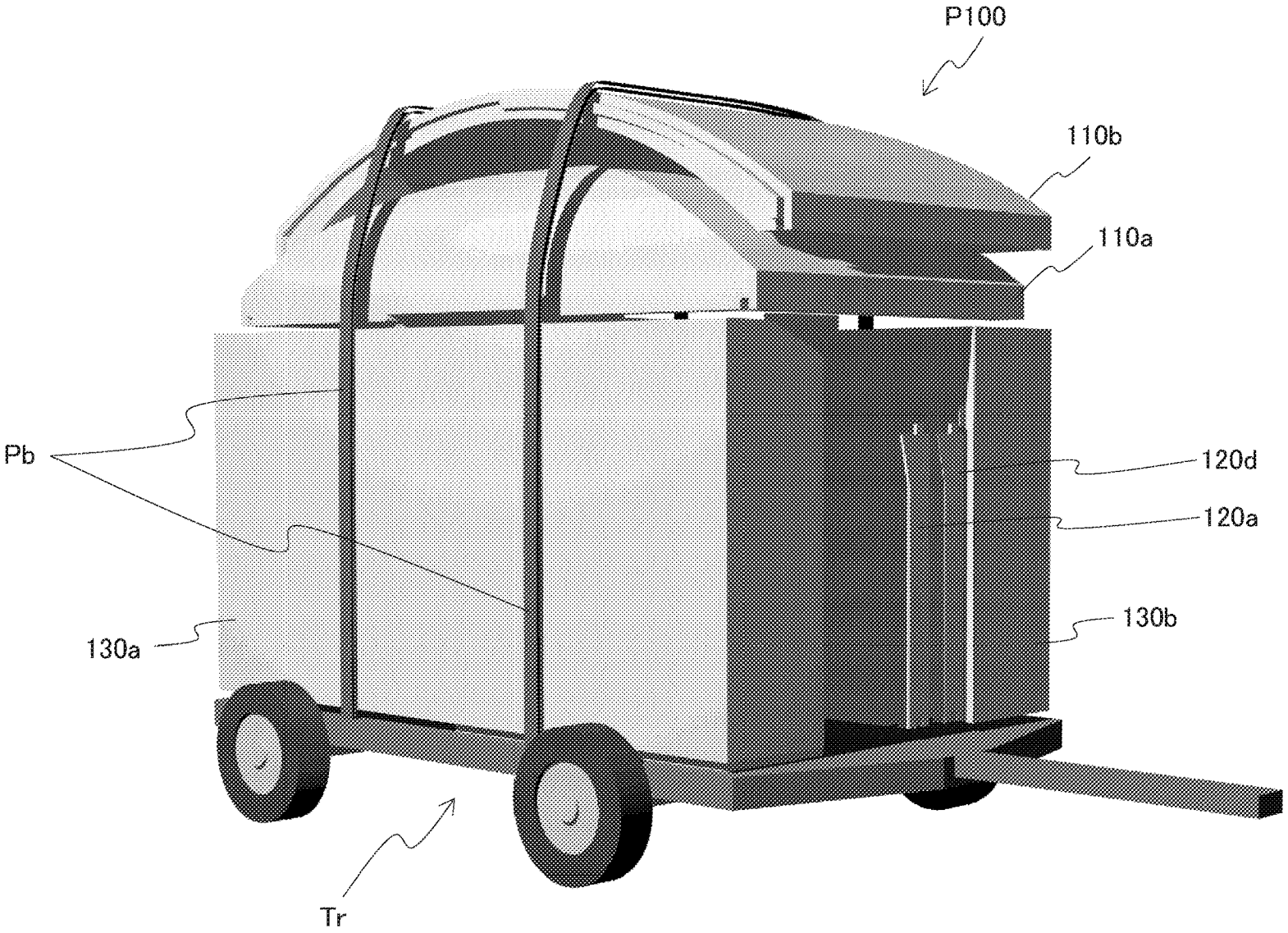
FIG. 10B is a perspective view showing constituent members of the structure 100 that are compactly stacked and loaded onto a trailer.

FIG. 10B is a perspective view showing constituent members of the structure 100 that are compactly stacked and loaded onto a trailer.

The base area (W1×D1) of the stack P100 (see Figure obtained by stacking the constituent members of the structure 100 is reduced compared to the base area (W×D) of the assembled structure 100. Thus, the stack can be transported on a trailer or the like as shown in FIG. 10B. When transporting on a trailer, the stack P100 can be secured on the trailer with, for example, a belt Pb made of resin fiber, carbon fiber, or the like.

In such a structure 100 of Embodiment 1, the front floor member 130*a* and the back floor member 130*b* are obtained by integrally forming the floor boards 103*a* and 103*b* with the wainscoting 3*a* and 3*b* surrounding the periphery thereof by using foam such as polystyrene foam. Thus, there is no joint section (joint) between the floor and walls of the structure. Hence, infiltration of water from below via a joint (e.g., infiltration of water from below when floated on water, or infiltration of moisture from below when installed on land) can be avoided. When installed, for example, on land, infiltration of water above floor level can be prevented in case of flooding.

The structure 100 is structured so that the structure itself floats on water. Even if water infiltrates the inside of the structure 100 for some reason, the structure 100 itself functions as a buoy, so that the structure would not sink into water. Even in case of flooding, etc., damage due to flooding can be minimized by floating on water as described above.

Since the structure 100 has a box-like form by combining floor members, wall members, and ceiling members, the structure can be installed simply by being placed on a roughly horizontal site without a foundation as in a freight container. Furthermore, the floor members, wall members, and ceiling members can each be replaced with those having a structure for forming a window, a door (entrance/exit), a ventilation port, or the like. Thus, the layout and locations of entrance/exit and window can be freely selected.

Since the structure 100 can be assembled by combining two ceiling members 110*a* and 110*b*, four wall members 120*a* to 120*d*, and two floor members 130*a* and 130*b*, the structure 100 can be transported in a pre-assembly state of the structure, i.e., in a state of the constituent members thereof that are compactly stacked, so that the structure can be readily transported.

The method of assembling the structure 100 of Embodiment 1 is not limited to the order described above. The method can fabricate an assembly of two floor members, an assembly of four wall members, and an assembly of two ceiling members in advance, then place the assembly of four wall members on the assembly of two floor members and join the assemblies, and lastly place the assembly of ceiling members on the assembly of wall members and join the assembly of ceiling members to the assembly of the wall members.

Furthermore, a structure with a deck can be fabricated by using one or more (e.g., two) floor members in addition to the floor members of the structure 100 of Embodiment 1.

Figure 11:
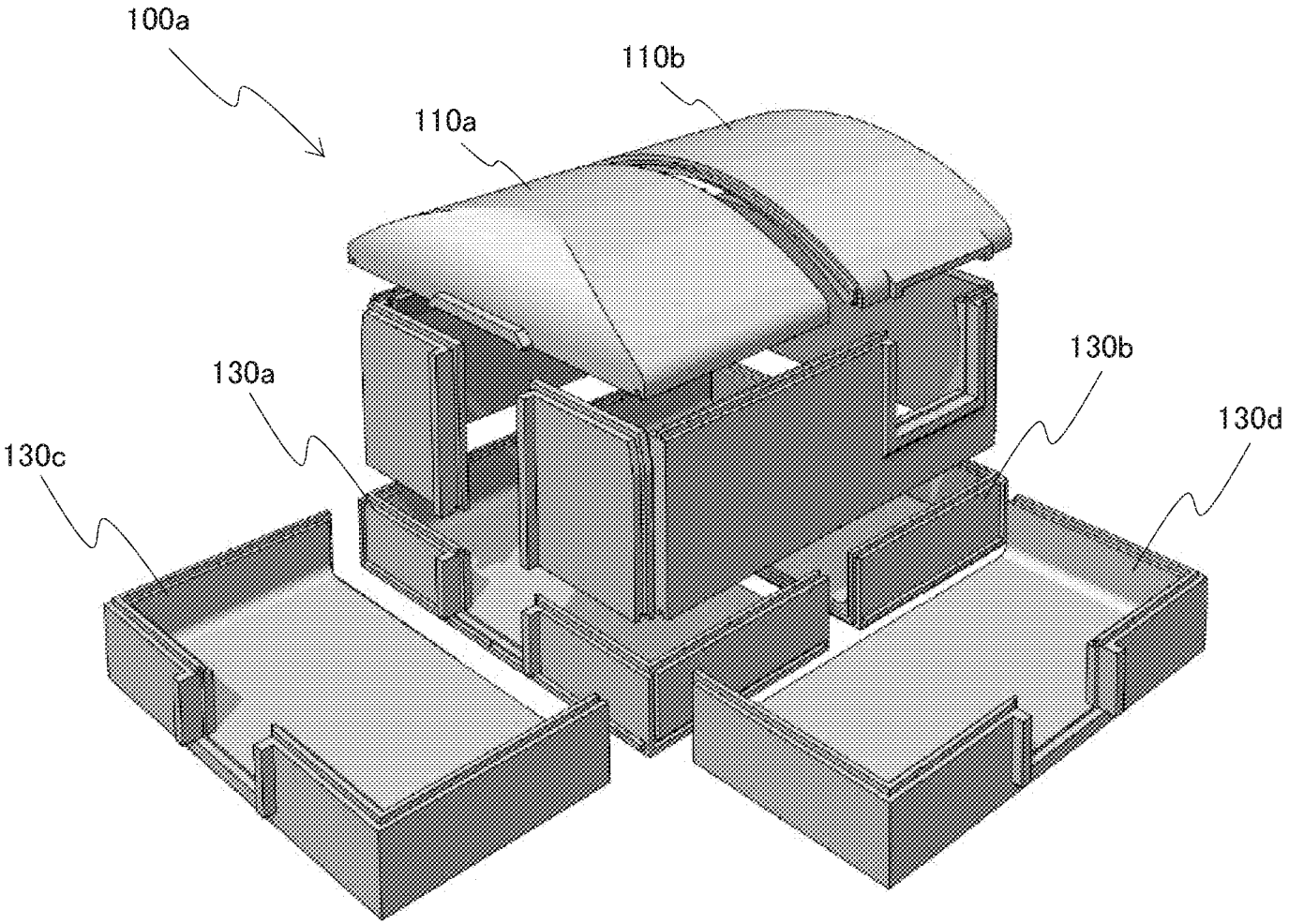
FIG. 11 is a perspective view for describing structure 100*b*, which is Modification Example 2 of the structure 100 shown in FIG. 2. The figure shows a method of assembling the structure 100*b*.

FIG. 11 is a perspective view for describing Modification Example 2 of the structure 100 shown in FIG. 2. The figure shows a method of assembling the structure 100*b* with a deck, which is suitable as, for example, a residence on water.

As shown in FIG. 11, two extra floor members 130*c* and 130*d* are prepared for a deck in addition to the front floor member 130*a* and the back floor member 130*b* as floor members.

As shown in FIG. 10(*a*), the structure 100 is formed as an assembly of two floor members, four wall members, and two ceiling members. As shown in FIG. 11, the additional floor member 130*c* is then attached on the front side of the front floor member 130*a* of the structure 100, and the additional floor member 130*d* is attached to span the front floor member 130*a* and the back floor member 130*b* on the right side surface of the structure 100.

This allows the structure 100*b* with a deck to be obtained.

Figure 12:
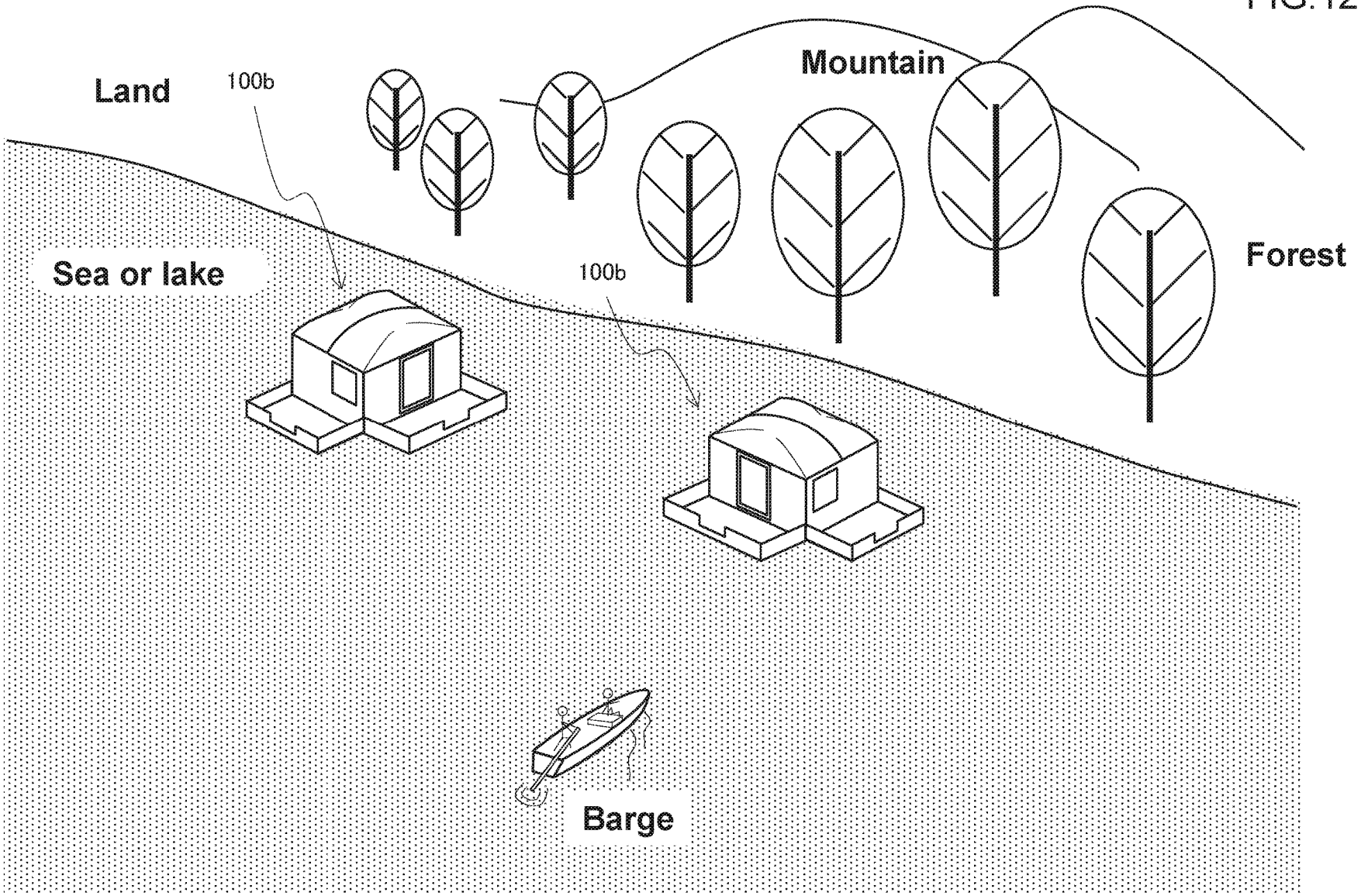
FIG. 12 is a perspective view showing the use of the structure 100*b* assembled by the method shown in FIG. 11 as a residence on water.

FIG. 12 is a perspective view showing the use of the structure 100*b* with a deck assembled by the method shown in FIG. 11 as a residence on water.

Since the structure 100*b* with a deck has a large buoyant force as a structure, the structure is suitable as a residence for life on water such as on the sea or lake. For example, the structure 100*b* with a deck can be floated and used as a residence at the shore near land as shown in FIG. 12. The deck portion can also be used as a temporary cargo storage when unloading cargo transported by a barge or the like or when loading cargo onto a barge.

The site where the structure of the invention is used is not limited to on water as described above. The structure of the invention can also be installed on land. The structure of the invention is preferably installed in, for example, an area susceptible to flooding, area with a potential of being submerged under water, or the like, because a user can benefit from the advantage due to its property of being able to float on water (e.g., water does not infiltrate or resistant to being submerged under water) when installed in such an area. Alternatively, the structure of the invention is preferably installed in, for example, an area that requires moving the entire building (e.g., pasture or the like), because a user can benefit from an advantage due to a property of being light weight (e.g., the entire structure can be moved). The installation site of the structure of the invention can be in any state, as long as the site is roughly horizontal. The structure of the invention can be installed even on, for example, grassland, sand, frozen ground, or the like.

The structure 100 of Embodiment 1 described above provides a living space with a standardized size. Meanwhile, the ceiling portion of the structure 100 is formed by joining front and back ceiling members, and a floor member of the structure 100 is configured by joining front and back floor members. Thus, a simple living space can be expanded by inserting a ceiling member for expansion between the front and back ceiling members and inserting a floor member for expansion between the front and back floor members. An expanded structure fabricated from expanding the structure 100 of Embodiment 1 is described hereinafter as Embodiment 2.

Embodiment 2

Figure 13:
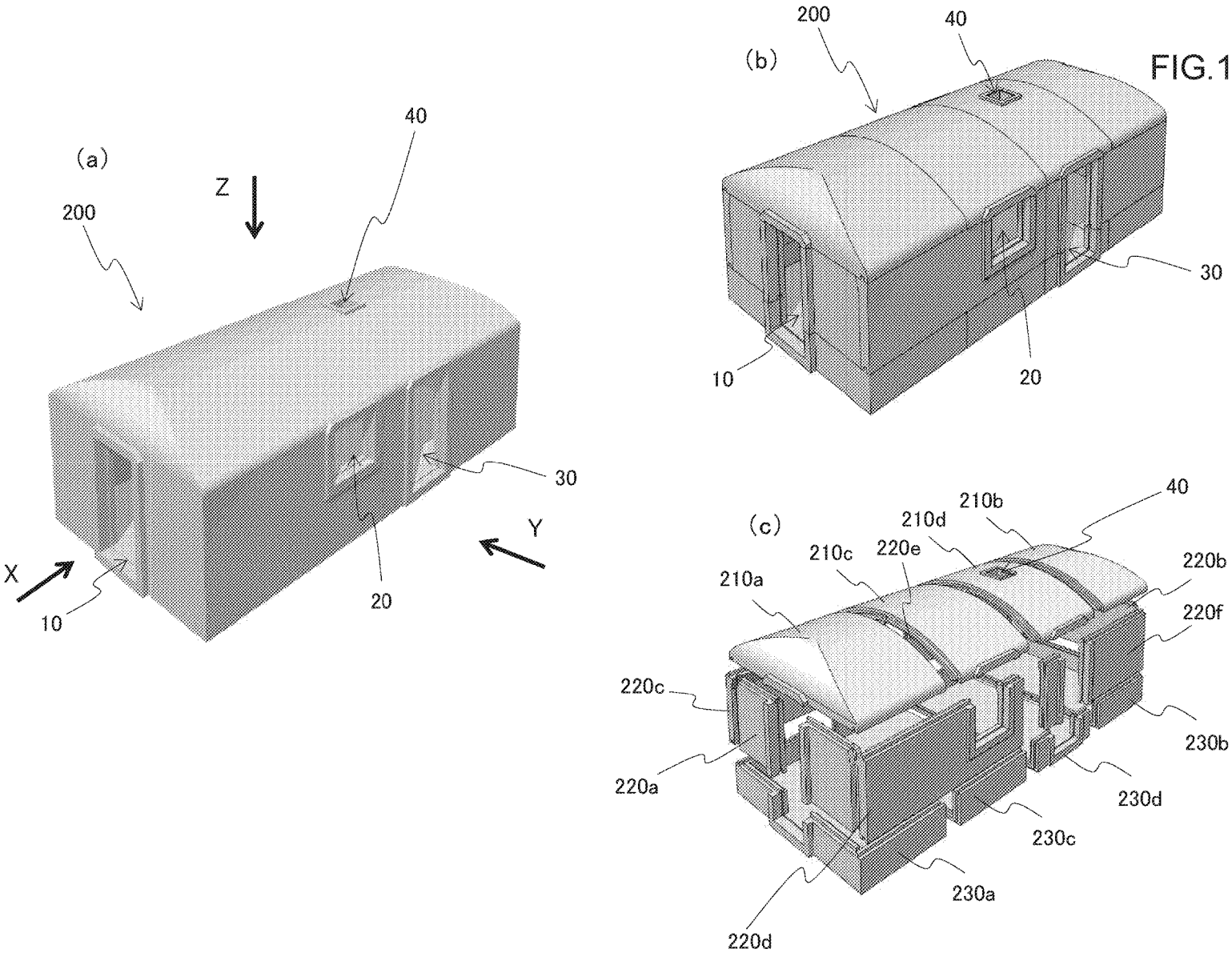
FIG. 13 is a perspective view for describing structure 200 according to Embodiment 2 of the invention.

FIG. 13 is a diagram for describing the structure 200 according to Embodiment 2 of the invention. FIG. 13(*a*)

shows the outer appearance of the structure 200. FIG. 13(*b*) shows the contour of the constituent members in the structure 200 shown in FIG. 13(*a*). FIG. 13(*c*) shows the structure 200 shown in FIG. 13(*a*) separated into individual constituent members.

The structure (second structure) 200 shown in FIG. 13 is an expandable structure. The entrances/exits 10 and 30 and window 20 are formed on a wall of the structure 200. In this regard, the structure 200 has four ceiling members, six wall members, and four floor members. The entrance/exit 10 and the window 20 are the same as those in the first structure 100 shown in FIG. 1, but the entrance/exit 30 is an entrance/exit located on the side surface of the second structure 200 unlike the entrance/exit 10 located on the front surface of the second structure 200. When the second structure 200 is expanded to the direction (Y direction in FIG. 13) orthogonal to the longitudinal direction (X direction), the entrance/exit is used to connect living spaces between the second structure and an adjacent structure.

The four ceiling members are a front ceiling member (first ceiling member) 210*a*, a back ceiling member (second ceiling member) 210*b*, and two ceiling members for expansion (third and fourth ceiling members) 210*c* and 210*d*.

In this regard, the front ceiling member 210*a* is located on the proximal side of the diagram of FIG. 13(*c*), and the back ceiling member 210*b* is located on the distal side of the diagram of FIG. 13(*c*). The two ceiling members for expansion 210*c* and 210*d* are located between the front ceiling member 210*a* and the back ceiling member 210*b*. One of the two ceiling members for expansion, the third ceiling member 210*c*, is a front ceiling member for expansion 210*c* that is adjacent to the front ceiling member 210*a*, and the other one of the two ceiling members for expansion, the fourth ceiling member 210*d*, is a back ceiling member for expansion 210*d* that is adjacent to the back ceiling member 210*b*.

The six wall members are a front wall member (first wall member) 220*a*, a back wall member (second wall member) 220*b*, a left front wall member (third wall member) 220*c*, a right front wall member (fourth wall member) 220*d*, a left back wall member (fifth wall member) 220*e*, and a right back wall member (sixth wall member) 220*f*.

In this regard, the front wall member 220*a* is a wall member located in the front when the structure 100 is viewed from the X direction of FIG. 13(*a*). The back wall member 220*b* is a wall member located on the back side of the structure 100 when the structure 100 is viewed from the A direction of FIG. 13(*a*). The left front wall member 220*c* is located on the proximal and left side of the diagram of FIG. 13(*c*). The right front wall member 220*d* is located on the proximal and right side of the diagram of FIG. 13(*c*). The left back wall member 220*e* is located on the distal and left side of the diagram of FIG. 13(*c*). The right back wall member (sixth wall member) 220*f* is located on the distal and right side of the diagram of FIG. 13(*c*).

The four floor members are a front floor member (first floor member) 230*a*, a back floor member (second floor member) 230*b*, and two floor members for expansion (third and fourth floor members) 230*c* and 230*d*.

In this regard, the front floor member 230*a* is located on the proximal side of the diagram of FIG. 13(*c*). The back floor member 230*b* is located on the distal side of the diagram in FIG. 13(*c*). The two floor members for expansion 230*c* and 230*d* are located between the front floor member 230*a* and the back floor member 230*b*. One of the two floor members for expansion, the third floor member 230*c*, is a front floor member for expansion adjacent to the front floor member 230*a*, and the other one of the two ceiling members for expansion, the fourth ceiling member 230*d*, is a back floor member for expansion that is adjacent to the back floor member 230*b*.

In this regard, each member is made of foam such as polystyrene foam. The expansion ratio of the floor members is less than the expansion ratios of the wall members and the ceiling members.

Specifically, the expansion ratio of the floor members in the structure 200 of Embodiment 2 is the same as the expansion ratio of the floor members in the structure 100 of Embodiment 1.

Further, the expansion ratios of the wall members and the ceiling members in the structure 200 of Embodiment 2 are the same as the expansion ratios of the wall members and the ceiling members in the structure 100 of Embodiment 1.

The structure (second structure) 200 can float on water by each of the four ceiling members, six wall members, and four floor members being made of foam.

The specific structure of each member is described hereinafter.

First, the first wall member to the sixth wall member are described.

(First Wall Member (Front Wall Member 220*a*) and Second Wall Member (Back Wall Member 220*b*))

The front wall member 220*a* and the back wall member 220*b* have the same structure as the front wall member 120*a* and the back wall member 120*b* in the structure 100 of Embodiment 1, respectively. Meanwhile, the left front wall member 220*c* and the left back wall member 220*e* have a structure that is partially different from the left wall member 120*c* in the structure 100 of Embodiment 1, and the right front wall member 220*d* and the right back wall member 220*f* have a structure that is partially different from the right wall member 120*d* in the structure 100 of Embodiment 1.

Figure 14:
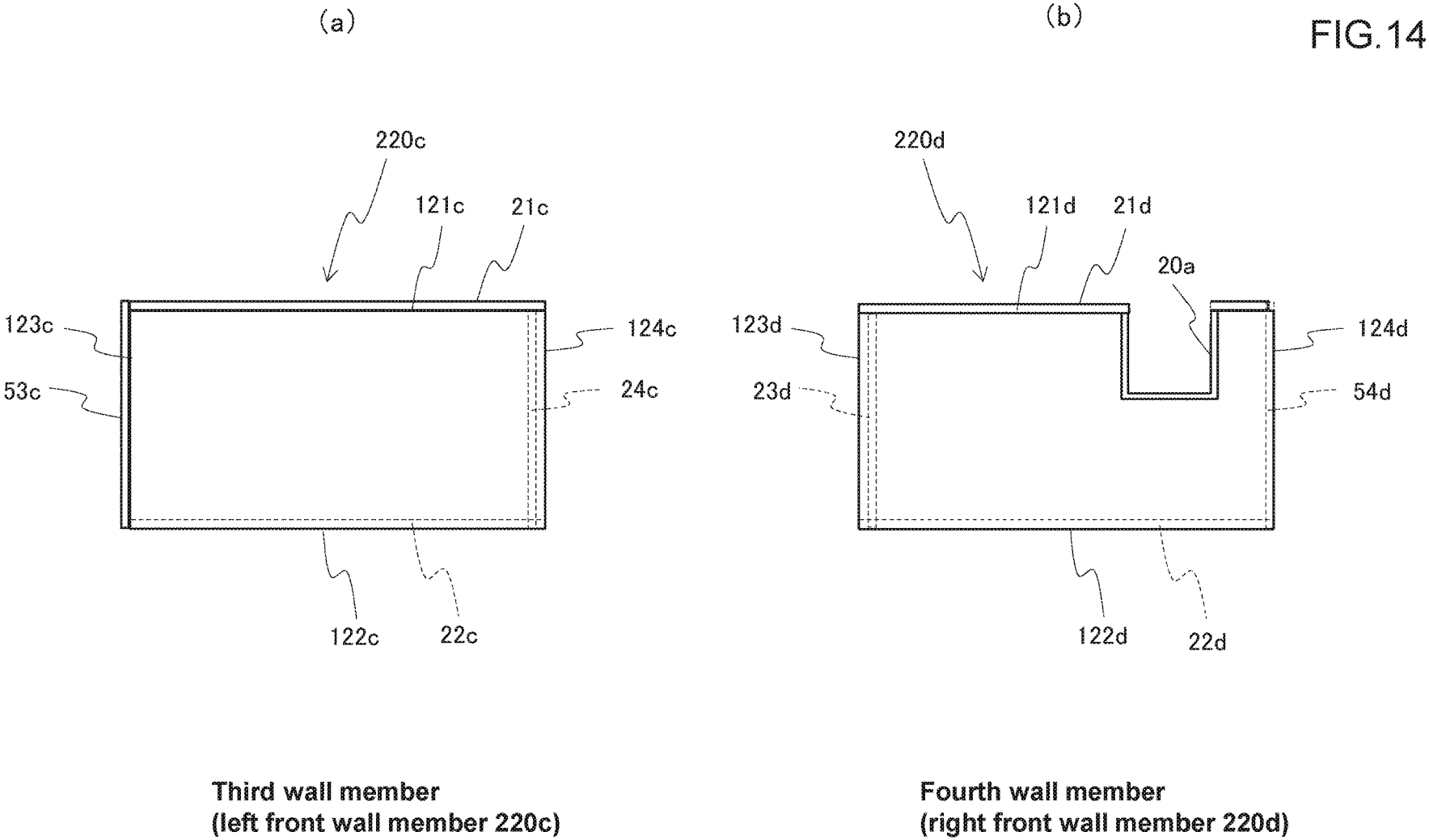
FIG. 14 is a plan view for describing the left and right wall members of the structure 200 shown in FIG. 13.

FIG. 14 is a plan view for describing the side wall members of the structure 200 shown in FIG. 13. FIG. 14(*a*) shows the exterior surface of the wall member (left front wall member) 120*c* located on the left and front side of the diagram of FIG. 13(*c*). FIG. 14(*b*) shows the exterior surface of the wall member (right front wall member) 120*d* located on the right and front side of the diagram of FIG. 13(*c*).

(Third Wall Member (Left Front Wall Member 220*c*))

As shown in FIG. 14(*a*), the left front wall member 220*c* has a linear protrusion 53*c* formed on the end surface of the third joint edge 123*c* instead of the linear groove 23*c* formed on the inside surface of the third joint edge 123*c* of the left wall member 120*c* in the structure 100 of Embodiment 1.

(Fourth Wall Member (Right Front Wall Member 220*d*))

As shown in FIG. 14(*b*), the right front wall member 220*d* has a linear groove 54*d* formed on the end surface of the fourth joint edge 124*d* instead of the linear groove 24*d* formed on the inside surface of the fourth joint edge 124*d* of the right wall member 120*d* in the structure 100 of Embodiment 1.

(Fifth Wall Member (Left Back Wall Member 220*e*))

The left back wall member 220*e* has the same structure as the right front wall member 220*d* shown in FIG. 14(*b*), and is configured so that the linear groove of the fourth joint edge of the left back wall member 220*e* fits with the linear protrusion 53*c* of the third joint edge 123*c* of the left front wall member 220*c*.

(Sixth Wall Member (Right Back Wall Member 220*f*))

The right back wall member 220*f* is provided with an opening to form the entrance/exit 30, which is the same as the entrance/exit 10 in the front wall member 220*a*, on the left front wall member 220*c*, and is configured so that the linear protrusion of the third joint edge of the right back wall member 220*f* fits with the linear groove 54*d* of the fourth joint edge 124*d* of the right front wall member 220*d*.

Figure 15:
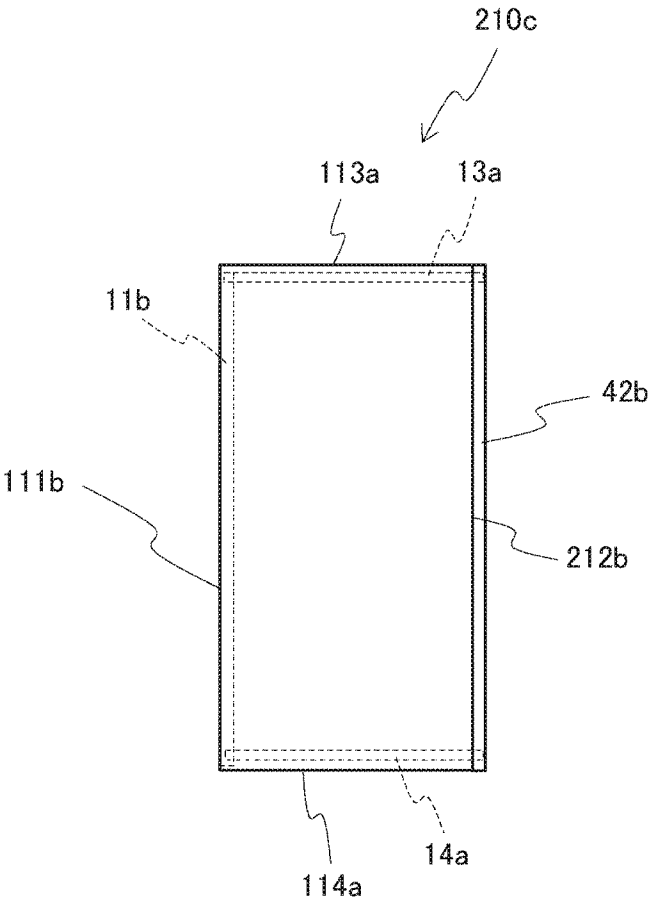
FIG. 15 is a plan view for describing the ceiling member for expansion of the structure 200 shown in FIG. 13.

FIG. 15 is a plan view for describing the ceiling member of the structure 200 shown in FIG. 13. Figure shows the structure of the second ceiling member from the proximal side of the diagram of FIG. 13(*c*) (front ceiling member for expansion 210*c*) when viewed from the top.

(First Ceiling Member (Front Ceiling Member 210*a*) and Second Ceiling Member (Back Ceiling Member 210*b*))

The front ceiling member 210*a* and the back ceiling member 210*b* in the structure 200 have the same structure as the front ceiling member 110*a* and the back ceiling member 110*b* in the structure 100 of Embodiment 1, respectively.

(Third Ceiling Member (Front Ceiling Member for Expansion 210*c*) and Fourth Ceiling Member (Back Ceiling Member for Expansion 210*d*))

The front ceiling member for expansion 210*c* in the structure 200 comprises a second joint edge 212*b* with the same curved shape as the first joint edge 111*b* instead of the second joint edge 112*b* of the back ceiling member 110*b* in the structure 100 of Embodiment 1, and has a linear protrusion 42*b* formed on the end surface of the second joint edge 212*b* of the front ceiling member for expansion 210*c* in the structure 200 of Embodiment 2 instead of the linear groove 12*b* formed on the bottom surface of the second joint edge 112*b* of the back ceiling member 110*b* of Embodiment 1.

The back ceiling member for expansion 210*d* has the same structure as the front ceiling member for expansion 210*c* other than having an air vent 40 formed thereon.

Figure 16:
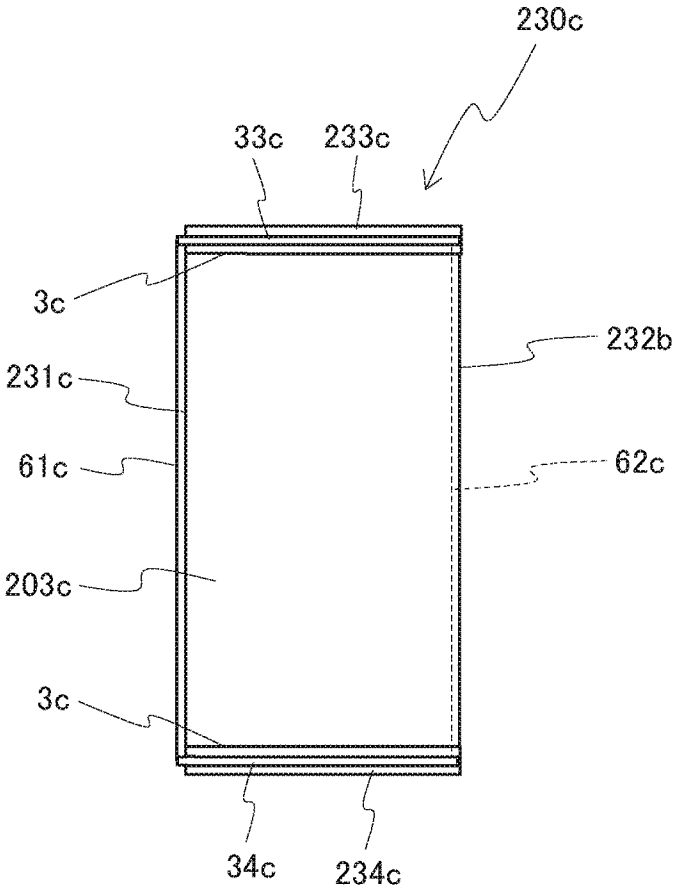
FIG. 16 is a plan view for describing the floor member for expansion of the structure 200 shown in FIG. 13.

FIG. 16 is a plan view for describing the floor member of the structure 200 shown in FIG. 13, showing the structure of the front floor member for expansion 230*c* located at the second location from the proximal side of the diagram of FIG. 13(*c*) when viewed from the top.

(First Floor Member (Front Floor Member 230*a*) and Second Floor Member (Back Floor Member 230*b*))

The front floor member 230*a* and the back floor member 230*b* in the structure 200 have the same structure as the front floor member 130*a* and the back floor member 130*b* in the structure 100 of Embodiment 1.

The front floor member for expansion 230*c* has a rectangular floor board 203*c* and a pair of wainscoting fragments 3*c* that are raised so as to oppose each other across the floor board 203*c* from the left side edge and the right side edge of the floor board. The floor board 203*c* and the wainscoting fragments 3*c* are integrally formed without a joint.

The front edge of the wainscoting fragment 3*c* and the front edge of the floor board 203*c* are first joint edge 231*c* that is connected to the front floor member 230*a*. A linear protrusion 61*c* is formed on the end surface of the first joint edge 231*c*.

The back edge of the wainscoting fragment 3*c* and the back edge of the floor board 203*c* are second joint edge 232*b* that is joined to the back floor member for expansion 210*d*. A linear groove 62*c* is formed on the end surface of the second joint edge 232*b*.

The back floor member for expansion 210*d* has the same structure as the front floor member for expansion 210*c*.

The structure of the structure 200 assembled with each member described above is now described using a cross-section.

Figure 17:
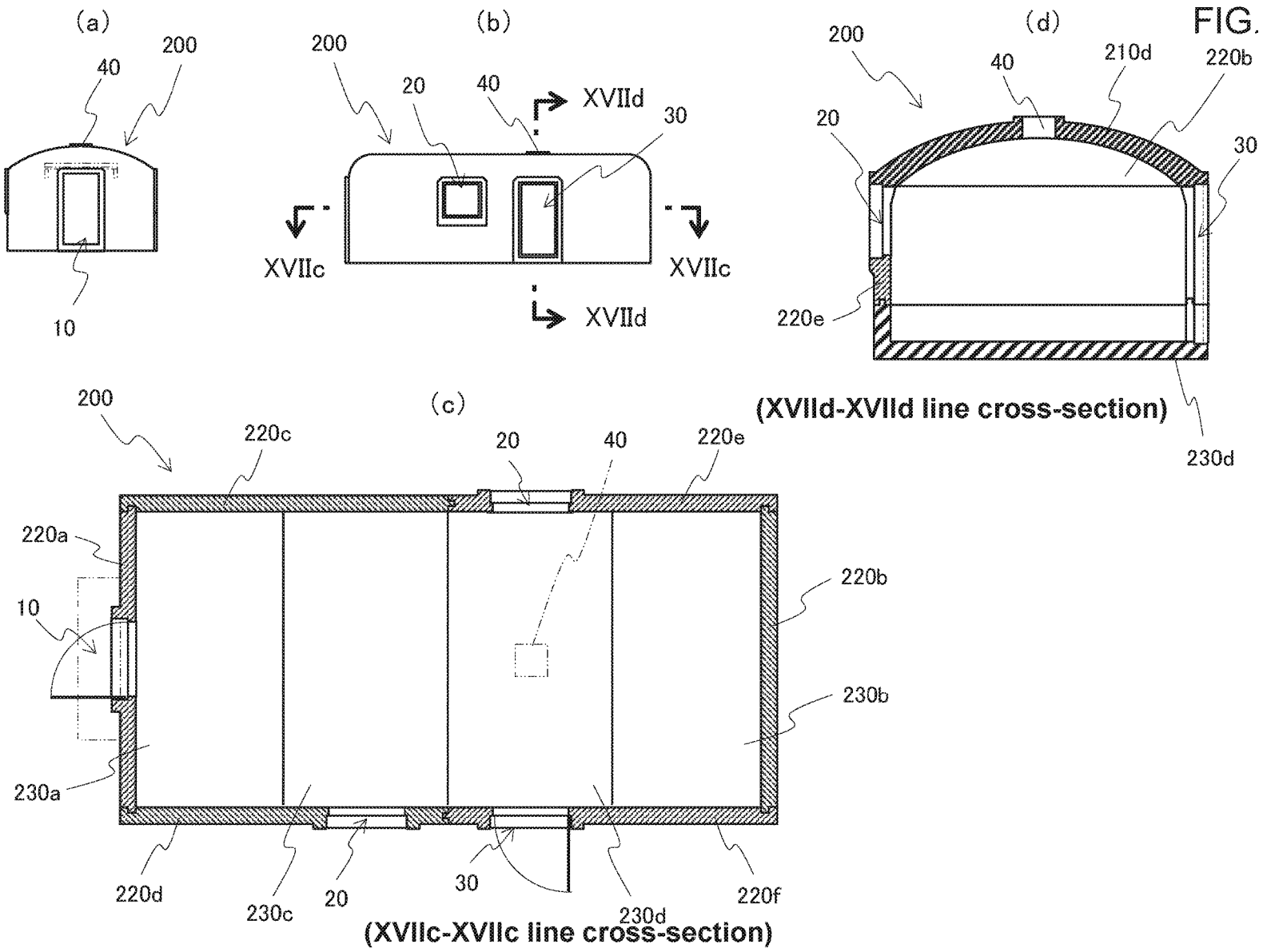
FIG. 17 is a diagram for describing the specific structure of the structure 200 shown in FIG. 13. The figure shows the structure of the cross-section that is perpendicular to the Z direction of FIG. 13 and the structure of the cross-section that is perpendicular to the X direction of FIG. 13 in the structure 200.

FIG. 17 is a diagram for specifically describing the structure 200 shown in FIG. 13(*a*). FIG. 17(*a*) is a side view showing the structure of the structure 200 shown in FIG. 13(*a*) when viewed from the X direction. FIG. 17(*b*) is a side view showing the structure of the structure 200 shown in FIG. 13(*a*) when viewed from the Y direction. FIG. 17(*c*) is a cross-sectional view at the XVIIc-XVIIc line of FIG. 17(*b*). FIG. 17(*d*) is a cross-sectional view at the XVIId-XVIId line of FIG. 17(*b*).

FIG. 17(*c*) shows that adjacent wall members of the six wall members are joined to each other at opposing joint edges.

Specifically, the left front wall member 220*c* and the left back wall member 220*e* are joined at their joint edges, and the left wall member consisting of the left front wall member 220*c* and the left back wall member 220*e* is joined to the front wall member 220*a* and the back wall member 220*b* in the same manner as the left wall member 120*c* in the structure 100 of Embodiment 1.

The right front wall member 220*d* and the left back wall member 220*f* are joined at their joint edges, and the right wall member consisting of the right front wall member 220*d* and the right back wall member 220*f* is joined to the front wall member 220*a* and the back wall member 220*b* in the same manner as the right wall member 120*d* in the structure 100 of Embodiment 1.

FIG. 17(*d*) shows that the left back wall member 220*e* and the right back wall member 220*f* are connected to the back floor member for expansion 210*d*.

Figure 18:
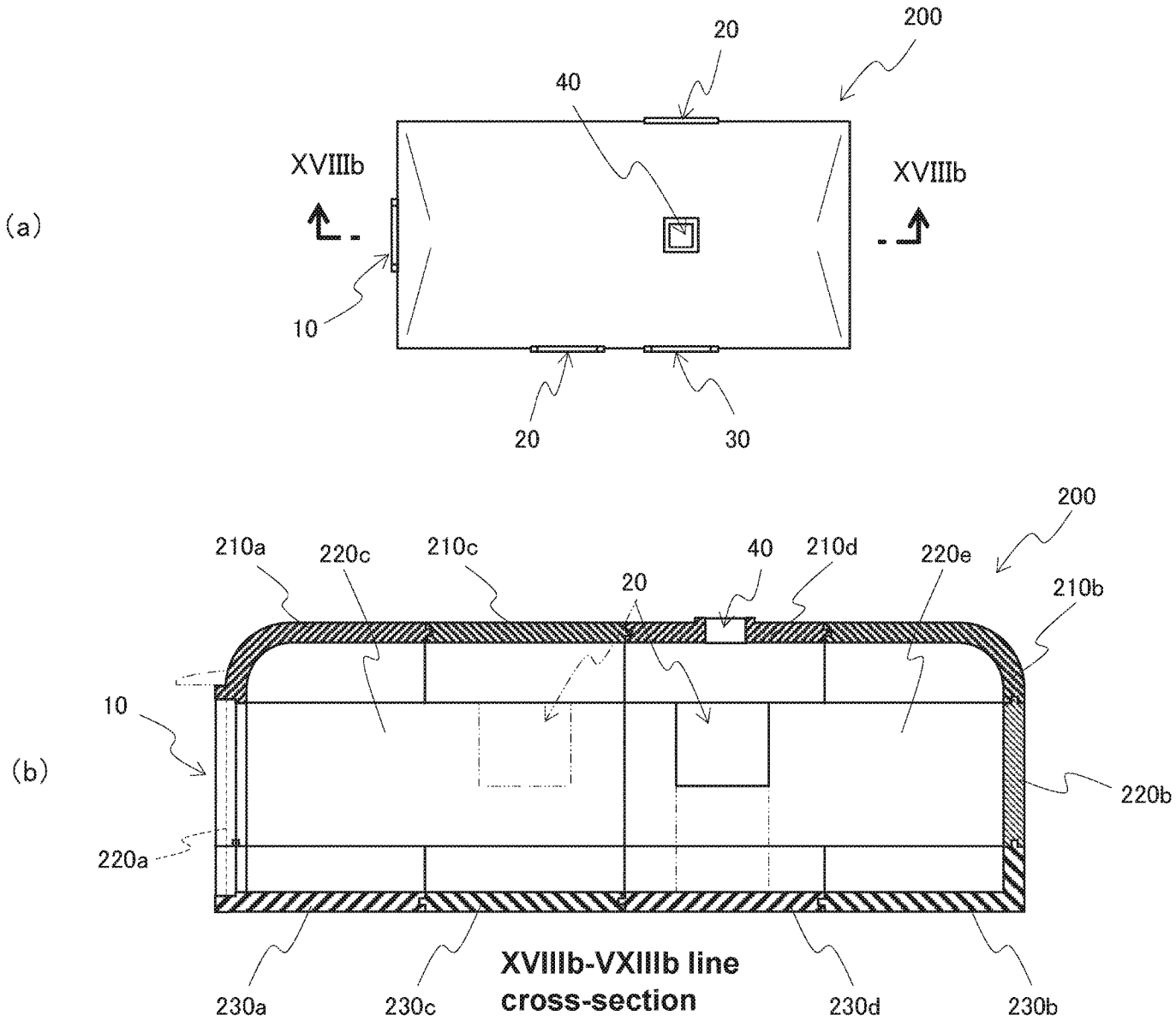
FIG. 18 is a diagram for describing the specific structure of the structure 200 shown in FIG. 13. The figure shows the structure of the cross-section that is perpendicular to the Y direction of FIG. 13 in the structure 200.

FIG. 18 is a diagram for specifically describing the structure 200 shown in FIG. 13(*a*). FIG. 18(*a*) is a plan view showing the structure of the structure 200 shown in FIG. 13(*a*) when viewed from the Z direction. FIG. 18(*b*) is a cross-sectional view at the XVIIIb-XVIIIb line of FIG. 18(*a*).

FIG. 18(*b*) shows the front ceiling member 210*a*, the front ceiling member for expansion 210*c*, the back ceiling member for expansion 210*d*, and the back ceiling member 210*b*, in which adjacent members are joined, and the front floor member 230*a*, the front floor member for expansion 230*c*, the back floor member for expansion 230*d*, and the back floor member 230*b*, in which adjacent members are joined.

FIG. 18(*b*) shows that each of the front wall member 220*a*, the left front wall member 220*c*, the left back wall member 220*e*, and the back wall member 220*b* is joined to one of the four ceiling members that is adjacent, and is joined to one of the four floor members that is adjacent.

Modification Example of Embodiment 2

The structure 200 of Embodiment 2 described above uses wall members with a size (length in the depth direction of structure 200) that spans two adjacent ceiling members and two adjacent floor members as left and right wall members (left front wall member 220*c*, left back wall member 220*e*, right front wall member 220*d*, and right back wall member 220*f*), but the size of the side wall members (left and right wall members) used in the structure 200 of Embodiment 2 is not limited to a size that spans the two adjacent ceiling members and two adjacent floor members.

Figure 19:
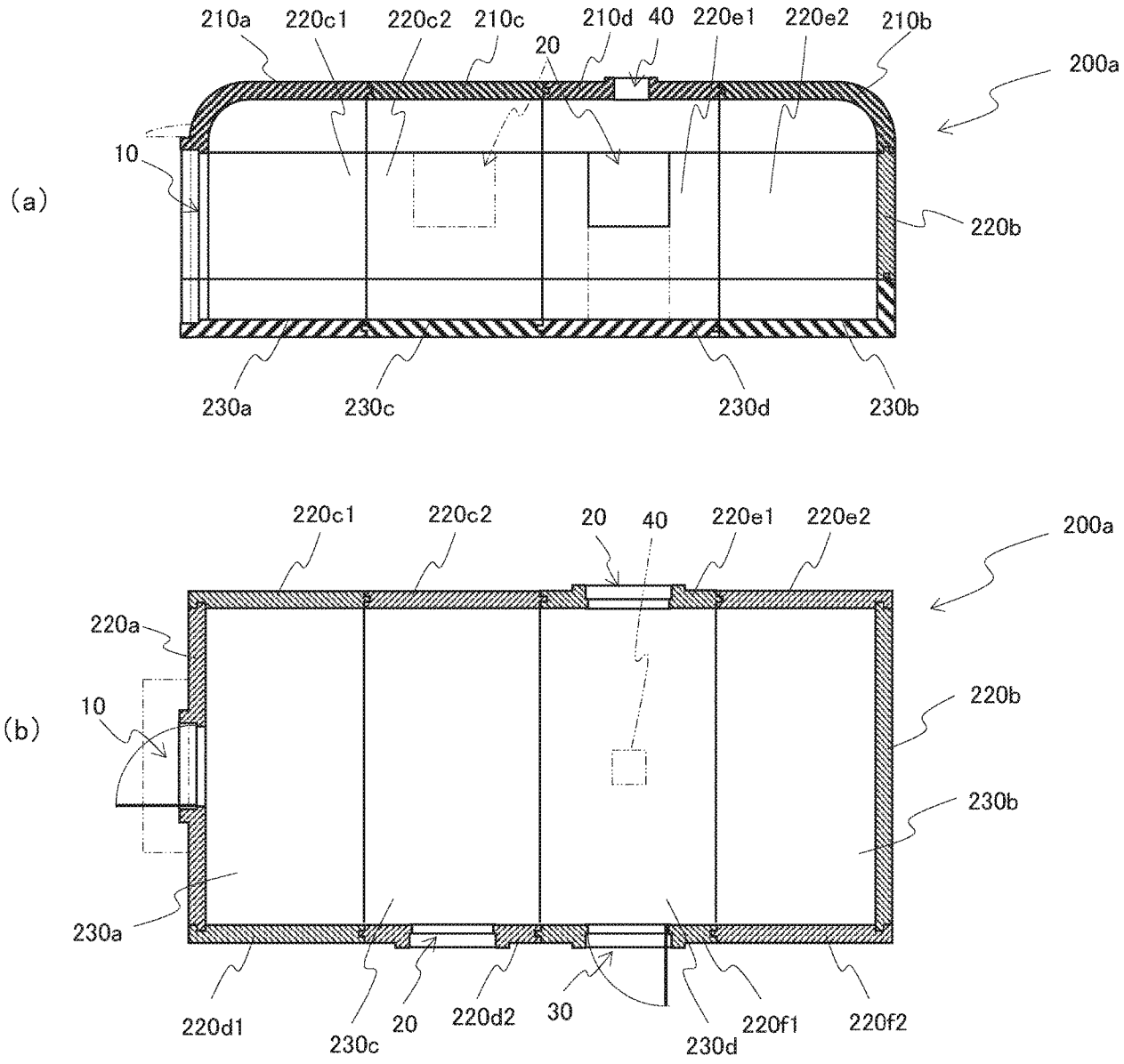
FIG. 19 is a diagram for describing structure 200*a*, which is a modification example of the structure 200 shown in FIG. 13.

FIG. 19 is a diagram for describing the structure 200*a*, which is a modification example of the structure 200 shown in FIG. 13(*a*). FIG. 19(*a*) shows the structure of the structure 200*a* at the cross-section corresponding to the cross-section at the XVIIIb-XVIIIb line shown in FIG. 18(*b*). FIG. 19(*b*) shows the structure of the structure 200*a* at the cross-section corresponding to the cross section at the XVIIc-XVIIc shown in FIG. 17(*c*).

The structure 200*a* in this Modification Example replaces the left front wall member 220*c* with two short left wall members 220*c*1 and 220*c*2, replaces the left back wall member 220*e* with two short left wall members 220*e*1 and

220*e*2, replaces the right front wall member 220*d* with two short left wall members 220*d*1 and 220*d*2, and replaces the right back wall member 220*f* with two short left wall members 220*f*1 and 220*f*2 in the structure 200 of Embodiment 2.

The two short left wall members 220*c*1 and 220*c*2 are obtained by dividing the left front wall member 220*c* in the structure 200 of Embodiment 2 in two. The two short left wall members 220*e*1 and 220*e*2 are obtained by dividing the left back wall member 220*e* in the structure 200 of Embodiment 2 in two. The two short left wall members 120*d*1 and 120*d*2 are obtained by dividing the right front wall member 220*d* in the structure 200 of Embodiment 2 in two. The two short left wall members 120*f*1 and 120*f*2 are obtained by dividing the right front wall member 220*f* in the structure 200 of Embodiment 2 in two.

By reducing the size (length in the depth direction of structure) of a wall member located on the side surface of the structure 200 in this manner, the expansion size in the structure 200 can be adjusted in a small unit of dimension. Further, the sizes of a plurality of wall members can be aligned. This can facilitate handling of a plurality of wall members and improve the efficiency of transport.

The method of assembling the structure 200 of Embodiment 2 is the same as the method of assembling the structure 100 of Embodiment 1.

For example, the floor members for expansion 230*c* and 230*d* are first placed between, and jointed to, the front floor member 230*a* and the back floor member 230*b* to fabricate a floor portion of the structure 200.

The front wall member 220*a* and the back wall member 220*b* are then disposed on the floor portion and joined to the front floor member 230*a* and the back floor member 230*b*. Moreover, each of the left front wall member 220*c*, the left back wall member 220*e*, right front wall member 220*d*, and the right back wall member 220*f* is disposed on the floor portion, and joined to a corresponding floor member among the four floor members, and adjacent wall members among the six wall members disposed to surround the floor member are joined to each other.

Each of the four ceiling members is then disposed on the wall members and joined to an opposing wall member among the six wall members, and adjacent ceiling members of the four ceiling members are joined to each other. These members are joined using an adhesive and fitting of a linear protrusion formed on one of the opposing joint edges with a linear groove formed on the other opposing joint edge.

In addition to the effect of the structure 100 of Embodiment 1, the size of the expanded structure 200 of Embodiment 2 in the depth direction can be expanded freely, for example, theoretically to 10s of meters by using the ceiling members for expansion 210*c* and 210*d* and the floor members for expansion 230*c* and 230*d* in this manner. This enables creation of a long building with a wider internal space without division compared to, for example, a plurality of structures 100 that are linked. Furthermore, living spaces that are compatible with various applications can be formed by using a combination of a structure that is not expandable (non-expandable structure) 100 described in Embodiment 1 and an expandable structure 200 in Embodiment 2.

Figure 20:
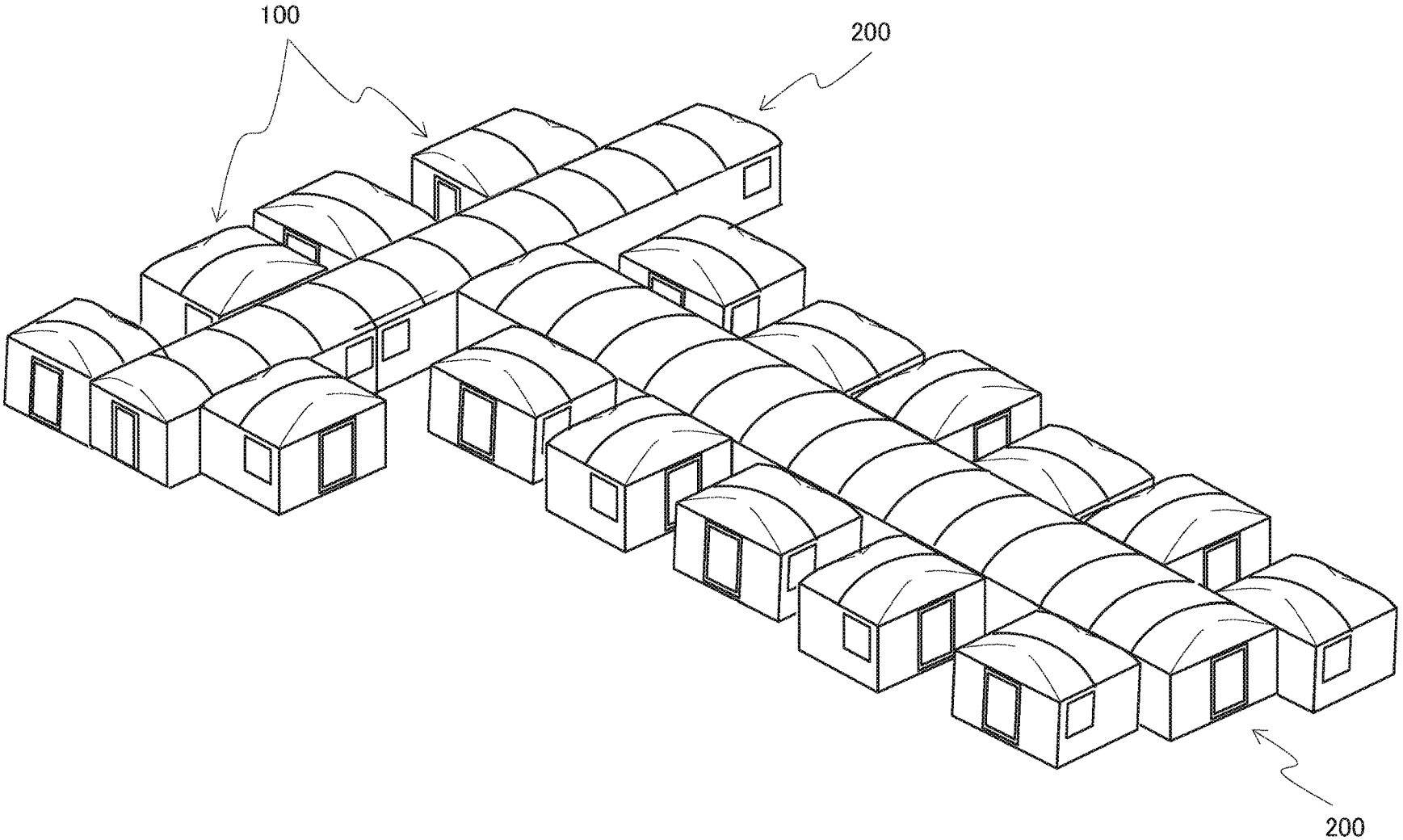
FIG. 20 is a perspective view showing an example of a layout of a plurality of structures obtained by combining a plurality of non-expandable structures (structure of FIG. 2) 100 and a plurality of expandable structures (structure of FIG. 13) 200.
Figure 21:
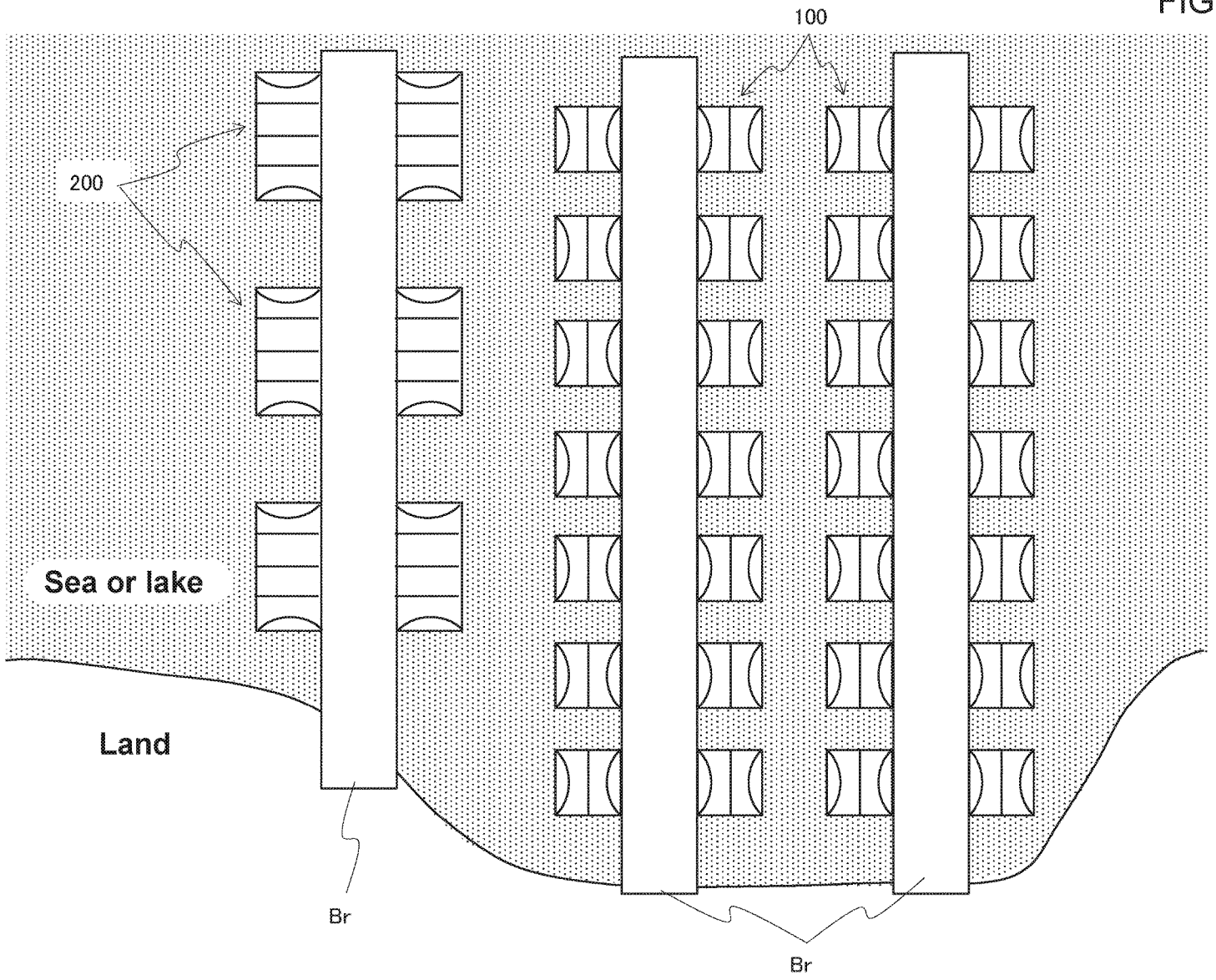
FIG. 21 is a schematic diagram for describing a plurality of non-expandable structures and a plurality of expandable structures, which are arranged on both sides of a pier moored at a wharf and utilized as a resort facility.

FIG. 20 is a perspective view showing an example of a layout of structures obtained by combining a plurality of non-expandable structures 100 and a plurality of expandable structures 200. FIG. 21 is a schematic diagram for describing a plurality of non-expandable structures and a plurality of expandable structures, which are arranged on both sides of a pier moored at a wharf and utilized as a resort facility.

For example, by using the expandable structure 200 and a plurality of non-expandable structures 100 as shown in FIG. 20, a living space connecting a plurality of non-expandable structures 100 can be formed with the expandable structure 200, and a layout of a living space that can be materialized with the structure 100 can be expanded to improve the degree of freedom in the design of a living space using the structure 100.

When a plurality of non-expandable structures and a plurality of expandable structures are arranged on both sides of a pier moored at a wharf and utilized as a resort facility as shown in FIG. 21, the scale as a lodging facility can be selected between a facility for a small number of people provided by a non-expandable structure and a facility for a large number of people provided by an expandable structure, depending on the number of customers.

While the above example described the use of a structure for residential purposes, the application of a structure is not limited to residential use. For example, a structure can be used for disaster prevention. Since a structure can float on water, the structure can be utilized, for example, as an evacuation facility that does not readily submerge under water during flooding.

As disclosed above, the present invention is exemplified by the use of its preferred embodiments. However, the present invention should not be interpreted to be limited to such embodiments. It is understood that the scope of the present invention should be interpreted based solely on the claims. It is understood that an equivalent scope can be practiced by those skilled in the art based on the descriptions of the present invention and common general knowledge from the specific descriptions in the preferred embodiments of the invention. It is also understood that any references cited herein should be incorporated herein by reference in the same manner as the contents are specifically described herein.

Examples

In this Example, a structure was fabricated by assembling polystyrene foam members. Two ceiling members, four wall members, and two floor members were utilized as members constituting the structure. As the floor members, floor members having wainscoting were utilized. A joint section of each member was joined using a urethane resin adhesive. After assembly, the entire structure was coated with a urethane resin material.

The fabricated structure had a base area of about 2.5 m×about 4.5 m, a height of about 2.6 m, and weight of about 500 kg. In this manner, a space where a human can enter was formed inside the structure. The ratio of the base area of the fabricated structure to the structure's own weight was base area ($m^2$):own weight (kg)=about 1:45.

The fabricated structure was floated on water. When people actually entered inside, the structure comfortably floated on water without infiltration of water or sinking even after housing four adults.

Figure 22:
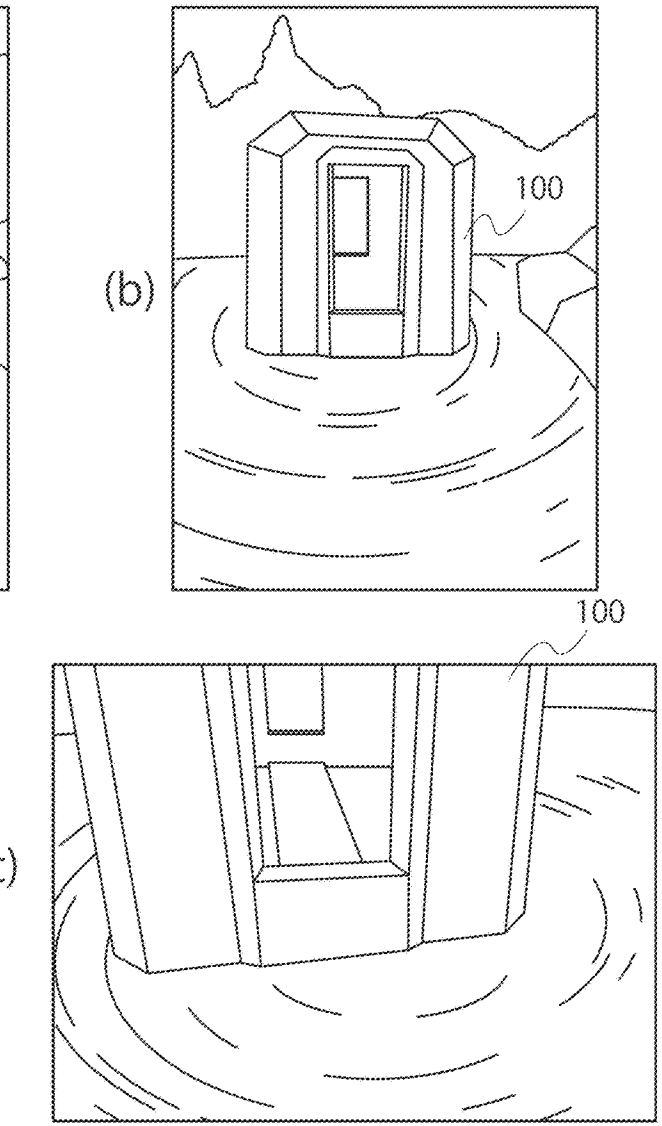
FIG. 22 shows a picture of a structure fabricated in the Examples when actually floated on water.

FIG. 22 shows a picture of a fabricated structure when actually floated on water. FIG. 22(*a*) is a picture capturing the outer appearance of the fabricated structure. FIG. 22(*b*) is a picture capturing the vicinity of the entrance/exit of the fabricated structure. FIG. 22(*c*) is a picture capturing the vicinity of the floor of the fabricated structure. As shown in FIG. 22, a part of the entrance/exit was blocked by a barrier to prevent infiltration of water from the entrance/exit in the fabricated structure. The barrier was also made of a foam material.

INDUSTRIAL APPLICABILITY

The present invention is useful as an invention, which can obtain a structure that can float on water as a structure providing an internal space.

REFERENCE SIGNS LIST

10, 30 Entrance/exit
11*a*, 11*b*, 12*b*, 13*a*, 13*b*, 14*a*, 14*b*, 22*a*-'22*d*, 23*c*, 23*d*, 24*c*, 24*d*, 32*a*, 62*c* Linear groove (linear recess)
12*a*, 21*a* to 21*d*, 23*a*, 23*b*, 24*a*, 24*b*, 31*a*, 31*b*, 32*b*, 33*a*, 33*b*, 34*a*, 34*b*, 42*b*, 61*c* Linear protrusion (linear convex section)
20 Window section
40 Air vent
100, 100*a*, 100*b*, 200, 200*a* Structure
110*a*, 210*a* Front ceiling member (first ceiling member)
110*b*, 210*b* Back ceiling member (second ceiling member)
111*a*, 111*b*, 121*a* to 121*d*, 131*a*, 131*b* First joint edge
112*a*, 112*b*, 122*a* to 122*d*, 132*a*, 132*b* Second joint edge
113*a*, 113*b*, 123*a* to 123*d*, 133*a*, 133*b* Third joint edge
114*a*, 114*b*, 124*a* to 124*d*, 134*a*, 134*b* Fourth joint edge
120*a*, 220*a* Front wall member (first wall member)
120*a*1 Front wall member left fragment
120*a*2 Front wall member right fragment
120*b*, 220*b* Back wall member (second wall member)
120*c* Left wall member (third wall member)
120*c*1, 120*c*2, 220*c*1, 220*c*2, 220*e*1, 220*e*2 Short left wall member
120*d* Right wall member (fourth wall member)
120*d*1, 120*d*2, 220*d*1, 220*d*2, 220*f*1, 220*f*2 Short right wall member
130*a*, 230*a* Front floor member (first floor member)
130*b*, 230*b* Back floor member (second floor member)
130*c*, 130*d* Floor member
210*c*, 210*d* Ceiling member for expansion
220*c* Left front wall member
220*e* Left back wall member
220*d* Right front wall member
220*f* Right back wall member
230*c*, 230*d* Floor member for expansion

The invention claimed is:

1. An expandable structure comprising:
at least one ceiling member;
at least four wall members; and
at least one floor member,
wherein the at least one floor member has a first portion constituting a floor of the structure and a second upstanding portion constituting a base of a wall,
wherein the first portion and the second portion are integrally formed and define a unitary, one-piece construction,
wherein each of the at least four wall members has:
a first joint edge that is joined to the at least one ceiling member;
a second joint edge that is joined to the at least one floor member;
a third joint edge that is joined to one of the at least four wall members adjacent to each of the at least four wall members; and
a fourth joint edge that is joined to the other one of the at least four wall members adjacent to each of the at least four wall members; and
wherein each of the at least one ceiling member, the at least four wall members, and the at least one floor member is composed of foam;
the at least one ceiling member being a plurality of ceiling members, and further comprising at least one ceiling member for expansion;
the at least four wall members being a plurality of wall members;
the at least one floor member being a plurality of floor members, and further comprising at least one floor member for expansion;
wherein the at least one ceiling member for expansion is joined between two of the plurality of ceiling members to form an expanded ceiling section,
wherein the at least one floor member for expansion is joined between two of the plurality of floor members to form an expanded floor section,
wherein the expanded ceiling section is joined to the expanded floor section with the plurality of wall members, and
wherein each said member is composed of foam.

2. The structure of claim 1, wherein
each of the plurality of floor members has four joint edges, and three of the four joint edges of each of the plurality of floor members have a shape that is joined to the plurality of wall members, and
each of the at least one floor member for expansion has four joint edges, and two of the four joint edges of each of the at least one floor member for expansion have a shape that is joined to the plurality of wall members.

3. The structure of claim 1, wherein
each of the plurality of ceiling members has four joint edges, and three of the four joint edges of each of the plurality of ceiling members have a shape that is joined to the plurality of wall members, and
each of the at least one ceiling member for expansion has four joint edges, and two of the four joint edges of each of the at least one ceiling member for expansion have a shape that is joined to the plurality of wall members.

4. A structure comprising:
at least one ceiling member;
at least four wall members; and
at least one floor member,
wherein the at least one floor member has a first portion constituting a floor of the structure and a second upstanding portion constituting a base of a wall,
wherein the first portion and the second portion are integrally formed and define a unitary, one-piece construction,
wherein each of the at least four wall members has:
a first joint edge that is joined to the at least one ceiling member;
a second joint edge that is joined to the at least one floor member;
a third joint edge that is joined to one of the at least four wall members adjacent to each of the at least four wall members; and
a fourth joint edge that is joined to the other one of the at least four wall members adjacent to each of the at least four wall members; and
wherein each of the at least one ceiling member, the at least four wall members, and the at least one floor member is composed of foam;

wherein:

(a) the at least one ceiling member comprises a first ceiling member and a second ceiling member, and each of the first ceiling member and the second ceiling member comprises a first joint edge, a second joint edge, a third joint edge, and a fourth joint edge, (b) the at least four wall members comprise a first wall member, a second wall member, a third wall member, and a fourth wall member, (c) the at least one floor member comprises a first floor member and a second floor member, and each of the first floor member and the second floor member comprises a first joint edge, a second joint edge, a third joint edge, and a fourth joint edge, (d) the first joint edge of the first wall member is joined to the first joint edge of the first ceiling member, the second joint edge of the first wall member is joined to the first joint edge of the first floor member, the third joint edge of the first wall member is joined to the fourth joint edge of the third wall member, and the fourth joint edge of the first wall member is joined to the third joint edge of the fourth wall member, (e) the first joint edge of the second wall member is joined to the second joint edge of the second ceiling member, the second joint edge of the second wall member is joined to the second joint edge of the second floor member, the third joint edge of the second wall member is joined to the fourth joint edge of the fourth wall member, and the fourth joint edge of the second wall member is joined to the third joint edge of the third wall member, (f) the first joint edge of the third wall member is joined to the third joint edge of the first ceiling member and the third joint edge of the second ceiling member, and the second joint edge of the third wall member is joined to the third joint edge of the first floor member and the third joint edge of the second floor member, (g) the first joint edge of the fourth wall member is joined to the fourth joint edge of the first ceiling member and the fourth joint edge of the second ceiling member, and the second joint edge of the fourth wall member is joined to the fourth joint edge of the first floor member and the fourth joint edge of the second floor member, (h) the second joint edge of the first ceiling member is joined to the first joint edge of the second ceiling member, and (i) the second joint edge of the first floor member is joined to the first joint edge of the second floor member.

5. The structure of claim 4, wherein the foam comprises polystyrene foam.

6. The structure of claim 4, wherein the ceiling member is composed of a first foam having a first expansion ratio, the wall members are composed of a second foam having a second expansion ratio, the floor member is composed of a third foam having a third expansion ratio, and the third expansion ratio is less than the first expansion ratio and the second expansion ratio.

7. The structure of claim 4, wherein the structure further comprises an external floor member constituting an external deck on an outside of the at least one floor member of the structure, and the external floor member is joined to the at least one floor member.

8. The structure of claim 4, wherein the wall has a first opening, and the first opening is surrounded by the ceiling member, the wall members, and the floor member.

9. The structure of claim 4, wherein the wall has a second opening, and the second opening is surrounded by the ceiling member and the wall members.

10. The structure of claim 4, wherein a ratio of a base area ($m^2$) of the structure to a weight of the structure (kg) is 1:30 to 1:80.

11. The structure of claim 4, further comprising a coating, wherein the coating is configured to at least cover each joint edge of the ceiling member, the wall members, and the floor member constituting the structure.

12. The structure of claim 11, wherein the coating is formed to cover an entire outer surface of the structure.

13. The structure of claim 4, wherein each of the ceiling member, the wall members, and the floor member constituting the structure comprises a coating that covers an entirety thereof.

14. The structure of claim 13, wherein a material of the coating at least has a waterproof property.

15. A method of fabricating a structure, comprising:

providing the structure of claim 4;

joining the at least four wall members to the at least one ceiling member and the at least one floor member, wherein each of the at least four wall members has at least four joint edges, and the at least four joint edges comprise a first joint edge that is joined to the at least one ceiling member, a second joint edge that is joined to the at least one floor member, a third joint edge that is joined to one of the at least four wall members adjacent to each of the at least four wall members, and a fourth joint edge that is joined to the other one of the at least four wall members adjacent to each of the at least four wall members; and applying a coating to at least cover each said joint edge of the ceiling member, the wall members, and the floor member that are joined.

* * * * *